US007553098B2

(12) United States Patent
Maekawa et al.

(10) Patent No.: US 7,553,098 B2
(45) Date of Patent: Jun. 30, 2009

(54) ROLL PAPER PRINTER

(75) Inventors: Hironori Maekawa, Suwa (JP); Jiro Momose, Shiojiri (JP); Motoyoshi Shirotori, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 358 days.

(21) Appl. No.: 11/502,031

(22) Filed: Aug. 9, 2006

(65) Prior Publication Data

US 2007/0036604 A1 Feb. 15, 2007

(30) Foreign Application Priority Data

Aug. 9, 2005 (JP) ..... 2005-230398
Dec. 9, 2005 (JP) ..... 2005-355738

(51) Int. Cl.
*B41J 15/00* (2006.01)
*B65H 16/02* (2006.01)
*B65H 26/08* (2006.01)

(52) U.S. Cl. ..... 400/613; 242/563; 242/563.2; 242/591; 242/595

(58) Field of Classification Search ..... 400/613; 242/563, 563.2, 591, 595
See application file for complete search history.

(56) References Cited

U.S. PATENT DOCUMENTS

| | | | | | |
|---|---|---|---|---|---|
| 4,204,180 | A | * | 5/1980 | Usui et al. | 335/205 |
| 5,820,068 | A | * | 10/1998 | Hosomi et al. | 242/563 |
| 5,833,830 | A | | 11/1998 | Hosomi et al. | |
| 5,884,861 | A | * | 3/1999 | Hosomi et al. | 242/563 |
| 6,024,322 | A | | 2/2000 | Skelly et al. | |
| 6,118,469 | A | | 9/2000 | Hosomi | |
| 6,135,384 | A | * | 10/2000 | Skelly et al. | 242/563 |

(Continued)

FOREIGN PATENT DOCUMENTS

| | | | |
|---|---|---|---|
| EP | 1231070 | * | 8/2002 |
| EP | 1 145 861 B1 | | 10/2004 |
| JP | 08-034554 | | 2/1994 |
| JP | 7-117919 | | 5/1995 |
| JP | 07-272120 | | 10/1995 |
| JP | 09-254474 | | 9/1997 |

(Continued)

OTHER PUBLICATIONS

European Search Report dated Nov. 3, 2006.

(Continued)

*Primary Examiner*—Daniel J Colilla
*Assistant Examiner*—Marissa L Ferguson-Samreth
(74) *Attorney, Agent, or Firm*—Edwards Angell Palmer & Dodge LLP; John J. Penny, Jr.

(57) ABSTRACT

A roll paper printer comprising a roll paper storage unit having a bottom surface on which a roll paper is held and rolls, an operable cover unit for opening and closing a roll paper loading opening to the roll paper storage unit, a roll paper size detection mechanism comprising a detection lever that can move in a direction protruding into the roll paper storage unit and a direction retracting from the roll paper storage unit, and an urging member for urging the detection lever in the protruding direction, wherein the detection lever separates from the roll paper and is pushed in the protruding direction when an outside diameter of the roll paper stored in the roll paper storage unit decreases to a predetermined size or less, and a detection lever retraction mechanism for moving the detection lever protruding into the roll paper storage unit in the retracting direction against the urging force of the urging member in conjunction with the operable cover unit opening.

19 Claims, 22 Drawing Sheets

U.S. PATENT DOCUMENTS

| | | | |
|---|---|---|---|
| 6,502,784 | B1 | 1/2003 | Sato |
| 6,629,666 | B2 | 10/2003 | Lee et al. |

FOREIGN PATENT DOCUMENTS

| | | | |
|---|---|---|---|
| JP | 09254474 | * | 9/1997 |
| JP | 11-130310 | | 5/1999 |
| JP | 2001-2296 | | 1/2001 |
| JP | 2001206602 | * | 7/2001 |
| JP | 2003-11453 | | 1/2003 |
| KR | 2002-0006199 | | 1/2002 |

OTHER PUBLICATIONS

"Sensing Mechanism," IBM Technical Disclosure Bulletin, IBM, XP000540211, pp. 129-130 (1995).

Examination Report in corresponding Korean Application (dated May 21, 2007).

* cited by examiner

ROLL PAPER PRINTER

The present invention claims benefit from Japanese Application Nos. 2005-230398 filed on Aug. 9, 2005 and 2005-355738 filed on Dec. 9, 2005, which are hereby incorporated by reference in its entirety.

BACKGROUND OF THE INVENTION

1. Field of Technology

The present invention relates to a roll paper printer having a roll paper size detection device featuring improvement enabling easy replacement of the roll paper.

2. Description of Related Art

One type of roll paper printer has the roll paper loaded so that the roll paper can simply roll on the bottom of the roll paper compartment. The roll paper typically has a long tape of recording paper wound into a roll on a hollow core that has a hole in the center. This type of roll paper printer also commonly has a roll paper size detection device for detecting the near-end of the roll when there is little roll paper left on the core. One type of roll paper size detection device has a lever that is inserted to the hole in the core of the roll paper.

This lever is pressed by an urging member against the round end (side) of the roll paper held in the roll paper compartment at a predetermined height above the bottom of the roll paper compartment. When the outside diameter of the roll paper gradually decreases as the paper is consumed by printing, the position of the core hole also gradually descends. When the amount of roll paper decreases so that the core hole has descended to the predetermined height, the detection lever slips off the round end of the roll paper and is inserted to the roll paper core. The detection lever is not limited to a mechanism that inserts the lever to the roll paper core, and can be a mechanism causing the lever to separate in the direction of the outside circumference of the roll from the round end of the roll. That the amount of remaining roll paper is low can be known by using a mechanical or other type of detection switch to detect movement of such a detection lever that separates from the round end of the roll paper into the core hole or to the outside surface of the roll.

A recessed channel into which the roll paper is dropped once the diameter has become small, and inclined guide surfaces for guiding the roll paper into this channel, are formed in the bottom of the roll paper compartment. By guiding the roll paper along these sloped surfaces into the recessed channel, the roll paper can be held at a position that can be detected by the detection lever, and the near-end of the roll paper can be reliably detected.

JP-A 9-254474 and JP-A 2003-11453 teach a roll paper printer having a roll paper compartment and a roll paper size detection device that use this type of detection lever to detect the near-end of the roll paper.

When there is no roll paper in the roll paper compartment, the detection lever of the roll paper detection device protrudes into the roll paper detection compartment. When loading the roll paper, such as when replacing the roll paper, the user must therefore push and retract the detection lever from the roll paper compartment using the end of the roll paper in order to place the roll paper into the roll paper compartment. If the detection lever is inserted to the core hole when removing the roll paper, the detection lever must also be pushed to the side and retracted so that the roll paper can be removed.

If the roll paper is loaded or removed quickly when loading or removing the roll paper, the detection lever may not be able to retract as quickly, resulting in the detection lever catching on the roll paper and interfering with loading and removing the roll paper. The detection lever may even be damaged.

In order to make loading and removing the roll paper easier, a taper with a large angle in the roll paper loading and removal direction must be included on the detection lever so that the detection lever can be pushed and retracted smoothly. However, rendering a taper with a large angle on the detection lever causes the problem of a drop in detection precision because setting the point at which the detection lever is inserted to the roll paper core with precision when the roll paper decreases to a predetermined remaining volume is more difficult than with a detection lever that does not have a taper. The same problem also occurs with a mechanism whereby the detection lever separates to the outside circumference of the roll paper.

SUMMARY OF THE INVENTION

An object of at least one embodiment of the present invention is therefore to provide a roll paper printer having a precision roll paper detection device that does not interfere with loading and removing the roll paper.

To achieve this object, a roll paper printer according to a preferred embodiment of the invention has a roll paper storage unit having a bottom surface on which a roll paper is held and rolls; an operable cover unit for opening and closing a roll paper loading opening to the roll paper storage unit; a roll paper size detection mechanism comprising a detection lever that can move in a direction protruding into the roll paper storage unit and a direction retracting from the roll paper storage unit, and an urging member for urging the detection lever in the protruding direction, wherein the detection lever separates from the roll paper and is pushed in the protruding direction when an outside diameter of the roll paper stored in the roll paper storage unit decreases to a predetermined size or less; and a detection lever retraction mechanism for moving the detection lever protruding into the roll paper storage unit in the retracting direction against the urging force of the urging member in conjunction with the operable cover unit opening.

Opening the operable cover unit of a roll paper printer according to this embodiment of the invention causes the detection lever to move in the retraction direction in which the detection lever retracts from the roll paper compartment. By appropriately setting the distance the detection lever moves in this retraction direction, the roll paper will not contact the detection lever when the roll paper is loaded into the roll paper compartment. In addition, when the detection lever is inserted to the roll paper core because the roll paper is depleted or near the end and the roll is therefore removed, the detection lever will be completely retracted from the core to a position where the detection lever will not interfere with the roll paper, and the roll paper or core can therefore be easily removed. The detection lever is therefore prevented from contacting the roll paper and interfering with the ease of loading or removing roll paper from the roll paper compartment.

There is also no need to form a tapered or inclined surface on the detection lever so that the roll paper pushes the detection lever smoothly out of the way when loading or removing roll paper. The near-end detection precision of the detection lever can therefore be improved.

The detection lever retraction mechanism in another embodiment of the invention operates in conjunction with the opening and closing action of the operable cover unit, and comprises a moving plate that moves bidirectionally between a first position (the position causing the detection lever to protrude) separated from the detection lever, and a second position (the position causing the detection lever to retract) pushing the detection lever in the retraction direction.

Further preferably, the detection lever retraction mechanism comprises an urging member for urging the moving plate toward the first position. When the operable cover unit opens, the force of the urging member acts on the operable cover unit in the closing direction of the operable cover unit. Therefore, when the operable cover unit is disposed to open to the front of the printer, damage resulting from the operable cover unit forcefully striking the surface on which the printer is installed as a result of the force opening the cover unit and the urging force of the urging member working together to cause the operable cover unit to open suddenly and forcefully is prevented.

Yet further preferably, the detection lever of the detection lever retraction mechanism is pressed against the round end (side) of the roll paper stored in the roll paper storage unit, and when the outside diameter of the roll paper decreases to a predetermined size or less, the detection lever separates from the round end of the roll paper and is pushed in the protruding direction.

The detection lever can be positioned, for example, so that the detection lever is pushed in the protruding direction to separate from the inside circumference edge of the round end of the roll paper and enter a core hole positioned in the center of the round end of the roll paper.

In a roll paper printer according to this embodiment of the invention, the roll paper storage unit stores the roll paper with the rotational axis of the roll paper aligned widthwise to the printer; the protruding direction and retraction direction of the detection lever is aligned widthwise to the printer; the roll paper loading opening is formed on the roll paper storage unit at the front side of the printer; and the operable cover unit can open to the printer front pivoting on a bottom end part of the operable cover unit, and has a platen defining the printing position of the print head attached at a top end portion of the operable cover unit.

In a roll paper printer according to this embodiment of the invention, the detection lever retraction mechanism operates in conjunction with the opening and closing of the operable cover unit, and comprises a moving plate that moves bidirectionally in a front-to-back direction of the printer between a retreated position (a position causing the detection lever to protrude) separated from the detection lever when the operable cover unit is closed, and an advanced position (a position causing the detection lever to retract) pushing the detection lever in a retraction direction when the operable cover unit is open. When the operable cover unit closes, the moving plate moves toward to the back of the printer to the retreated position and separates from the detection lever. The detection lever is therefore pushed in the protruding direction, is pressed against the round end of the roll paper, and can detect the size (near-end) of the roll paper. When the operable cover unit opens, the moving plate moves toward the front of the printer to the advanced position and pushes the detection lever to the retracted position, thus causing the detection lever to retract from the roll paper compartment.

The detection lever retraction mechanism preferably has an urging member for urging the moving plate towards the back of the printer.

The detection lever of this roll paper size detection mechanism can be disposed so that it is pushed in the protruding direction when the detection lever separates from the circumferential edge of the round end of the roll paper. More specifically, when the roll paper is near the end, the detection lever separates from the outside circumference edge of the round end of the roll paper and moves to the outside circumference surface of the roll paper, and thus detects the near-end of the roll.

Further preferably in this roll paper printer, the roll paper storage unit stores the roll paper with the rotational axis of the roll paper aligned widthwise to the printer; the detection lever is pushed in the protruding direction when the detection lever separates from the outside circumference edge of the roll paper end and moves to the outside surface; the roll paper loading opening is formed to the roll paper storage unit at the front side of the printer; the operable cover unit can open to the printer front pivoting on a bottom end part of the operable cover unit, and has a platen defining the printing position of the print head attached at a top end portion of the operable cover unit; and the roll paper stored in the roll paper storage unit is pressed to the operable cover unit side while being advanced toward the printing position.

When the recording paper is pulled from the roll paper and advanced to the printing position, the roll paper is pressed against the operable cover unit positioned in front of the roll paper compartment. As a result, the roll paper, which rests and rolls on the bottom of the roll paper compartment, does not roll back and forth inside the roll paper compartment, and is held at a forward position.

So that the roll paper can be held at a predetermined position inside the roll paper compartment, a recessed channel and sloped guide surfaces for guiding the roll into this channel as the roll diameter decreases are conventionally formed on the bottom of the roll paper compartment. However, forming this recessed channel and sloped guide surfaces increases the vertical size of the roll paper compartment, and thus impedes reducing the size of the printer. This is particularly disadvantageous for reducing the height of a printer having an operable cover unit disposed to the front of the printer to pivot at the bottom and open to the front of the printer so that the roll paper can be replaced in the roll paper compartment from the front of the printer.

When the printer is used for printing receipts and is installed on a low shelf below the counter in a fast food restaurant, for example, the printer must be short. In addition, the paper exit must be disposed facing forward at the top part of the printer so that the operator can easily remove the printed paper from the front of the printer.

The arrangement of the present invention does not require rendering such a recessed channel and sloped guide surfaces on the bottom of the roll paper compartment, and enables the bottom of the roll paper compartment to be flat. The invention therefore reduces the increase in the height of the roll paper printer while still holding the roll paper at a predetermined position in the roll paper compartment so that the near-end of the roll paper can be reliably detected.

Preferably, an upward-facing tapered surface rising toward the printer top is formed at a front end part of the detection lever facing the operable cover unit; and the slope of the upward-facing tapered surface is set so that pushing the operable cover unit in the closing direction enables roll paper disposed between the upward-facing tapered surface and the operable cover unit to move over the upward-facing tapered surface to the back side of the detection lever.

This arrangement avoids the problem of not being able to completely close the operable cover unit because the detection lever protrudes into the roll paper compartment before the roll paper is stored in the roll paper compartment when the operable cover unit is closed, and the roll paper becomes held between the front part of the detection lever and the operable cover unit.

Further preferably, a back-facing tapered surface facing the printer back is formed at a side part of the detection lever on the inside facing the roll paper storage unit; and the back-facing tapered surface can contact the outside circumference edge part of the end of roll paper moving from the back of the detection lever to the front.

If the roll paper moves to the back inside the roll paper compartment so that the detection lever separates from the end, and the roll paper then moves from the back to the front, this arrangement causes the outside circumference edge of the roll to contact the back-facing tapered surface so that the roll paper can move easily forward while pushing the detection lever in the retraction direction and restore the detection lever to the position pressed against the round end of the roll paper.

Yet further preferably, a tapered guide surface facing the inside widthwise to the printer is formed at a top part of the detection lever; and this tapered guide surface can contact the outside circumference edge of the end of the roll paper moving down from the top of the detection lever.

If the roll paper rests on the detection lever when the operable cover unit is closed, this aspect of the invention assures that the outside circumference edge contacts this tapered guide surface. The weight of the roll paper therefore pushes down on the tapered guide surface, thereby pushing the detection lever in the retraction direction while the roll paper descends to the bottom of the roll paper compartment and leaves the detection lever pressed against the round end of the roll paper.

Other objects and attainments together with a fuller understanding of the invention will become apparent and appreciated by referring to the following description and claims taken in conjunction with the accompanying drawings.

DESCRIPTION OF THE PREFERRED EMBODIMENTS

A preferred embodiment of a roll paper printer according to the present invention is described below with reference to the accompanying figures.

A roll paper printer according to a first embodiment of the invention is described below with reference to FIG. 1 to FIG. 8.

Figure 1:
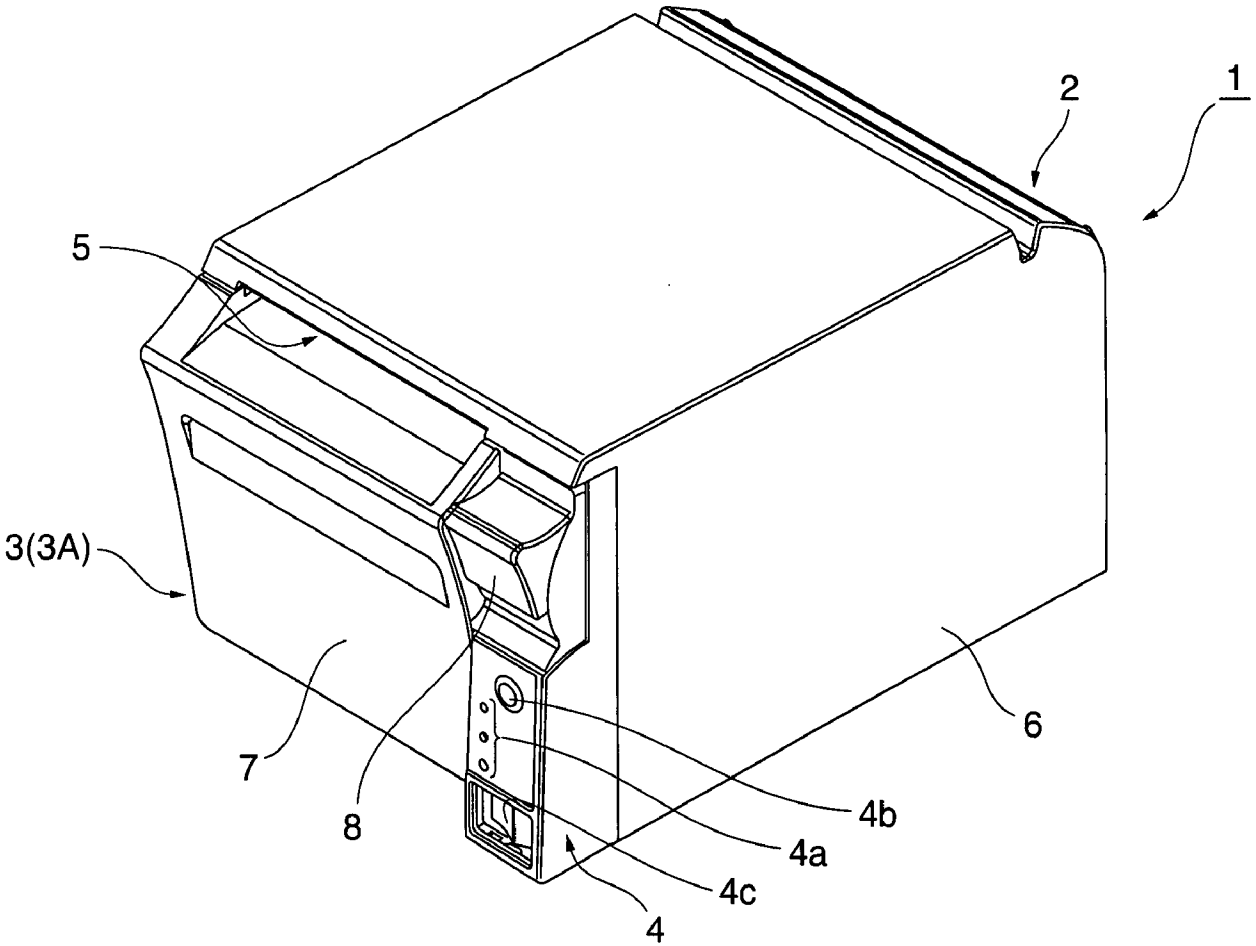
FIG. 1 is an oblique external view of a roll paper printer according to a first embodiment of the invention.
Figure 2:
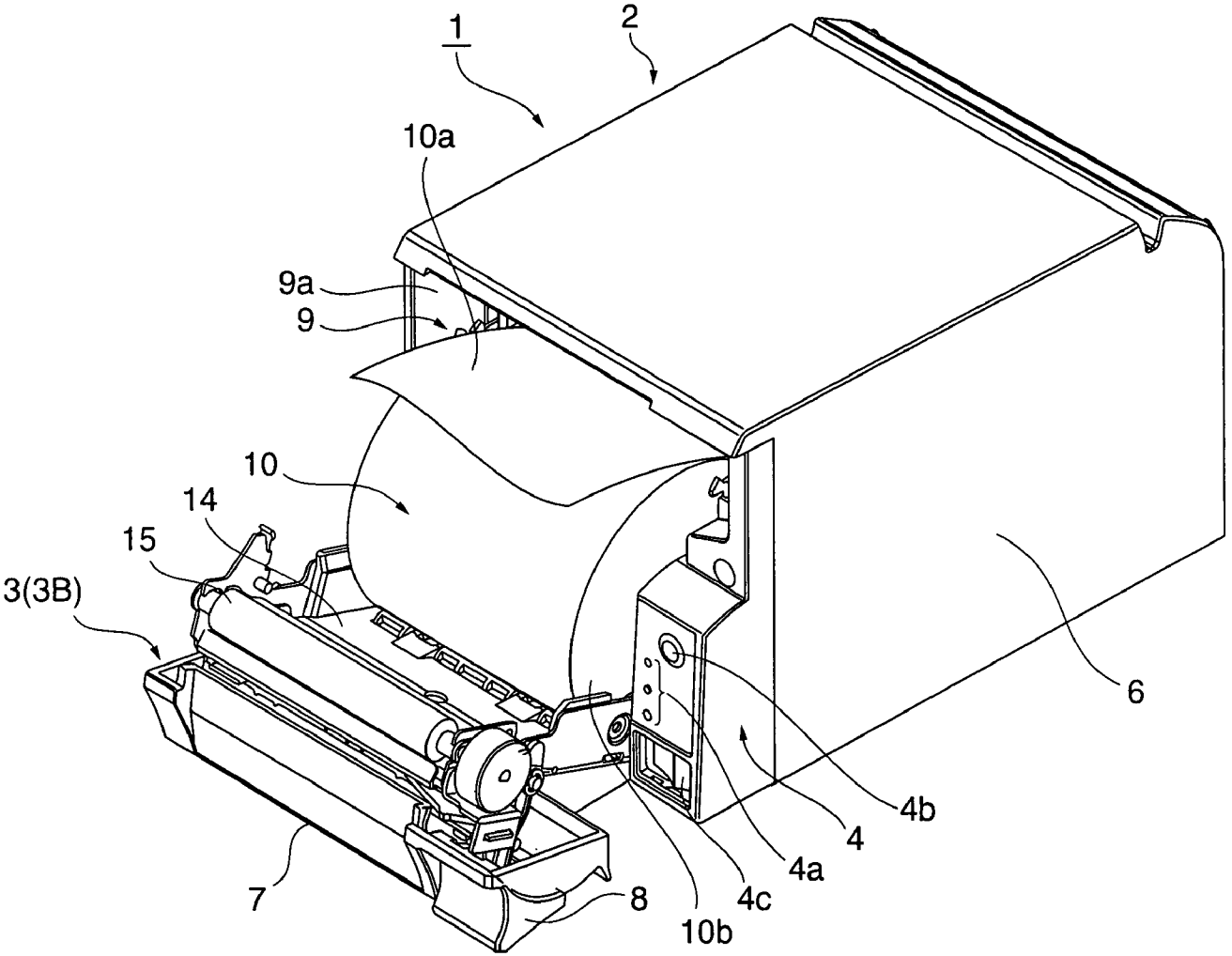
FIG. 2 is an oblique external view showing the roll paper printer with the operable cover open.

FIG. 1 is an oblique external view of a roll paper printer according to the present invention, and FIG. 2 an is oblique view showing the printer when the operable cover unit is open.

A roll paper printer 1 according to this embodiment of the invention has a printer chassis 2 with an operable cover unit 3 attached at the front. An operating panel unit 4 is disposed to a front corner of the printer chassis 2. A paper exit 5 extending widthwise to the printer is formed at the top part of the operable cover unit 3 at the front of the printer.

The printer chassis 2 is covered by a box-like printer case 6 that has a large dimension in the depth direction and is open at the front and bottom sides. An operable cover case 7 that defines the printer front is attached at the front of the operable cover unit 3. The operating lever 8 located at the operating panel unit 4 releases a cover lock not shown, thereby releasing and causing the operable cover unit 3 to swing forward and open pivotably on the bottom end part of the operable cover unit 3, as shown in FIG. 2. Opening the operable cover unit 3 opens a roll paper loading opening 9*a* at the front of the internal roll paper compartment 9 so that the roll paper 10 can be replaced.

A state indicator group 4*a* of LEDs, for example, a feed button 4*b*, and a power switch 4*c* are provided on the front of the operating panel unit 4.

As further described below, a roll paper size detection mechanism for detecting when the roll paper stored inside has decreased to a predetermined size (a predetermined diameter) is also disposed inside the roll paper compartment 9. When a control unit not shown disposed inside the roll paper printer 1 detects that the roll paper has decreased to or below this predetermined size, an indicator in the state indicator group 4*a* is driven to light steady or blink, for example, to inform the user. If the roll paper printer 1 is connected to a terminal device not shown, a message may also be presented on the terminal device, for example.

Figure 3:
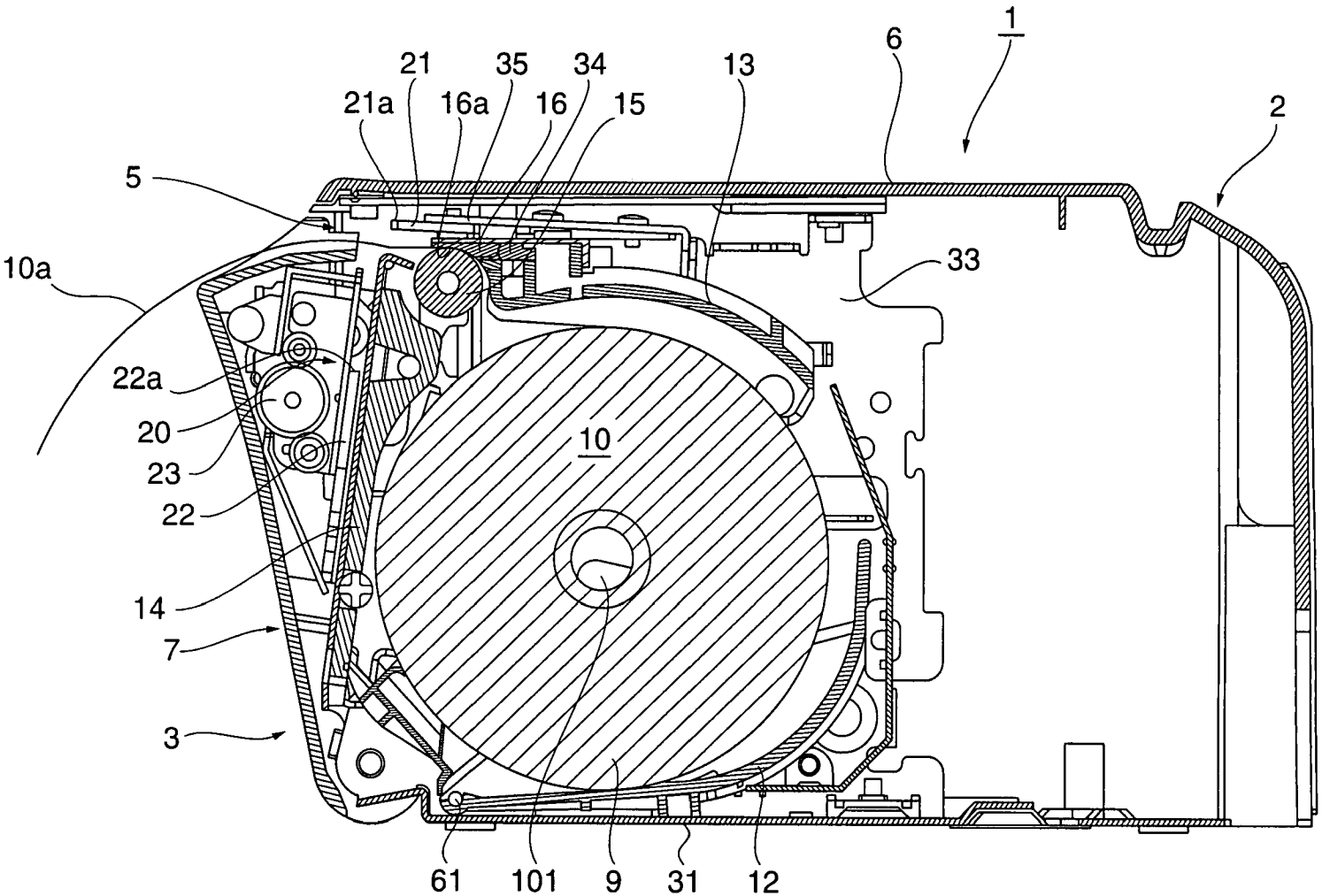
FIG. 3 is a schematic view showing the internal arrangement of the roll paper printer.

FIG. 3 is a schematic view of the inside of the roll paper printer 1. A roll paper compartment 9 formed inside the roll paper printer 1 is surrounded by a curved bottom panel 12 extending widthwise to the printer, a top panel 13 extending widthwise to the printer, and front panel 14 extending widthwise to the printer and generally conforming to the shape of the roll paper 10. The roll paper 10 is held so that it can rotate freely on the paper guide bottom 12 inside the roll paper compartment 9.

A core hole 101 is rendered in the center of the roll paper 10. The tape of recording paper 10*a* that is delivered from the roll paper 10 is pulled to the front past the printing position between the platen roller 15 and thermal print head 16, and is discharged to the front of the printer from the paper exit 5 disposed in front of the printing position. A scissor type paper cutting device 20 is disposed in front of the paper exit 5.

The paper cutting device 20 has a fixed blade 21 disposed on the printer chassis 2 side, and a movable blade 22 and movable blade drive mechanism 23 disposed on the operable cover unit 3 side. The fixed blade 21 is disposed substantially horizontally widthwise to the printer with the cutting edge 21*a* facing forward. The movable blade 22 is disposed substantially vertically widthwise to the printer with the cutting edge 22*a* facing up at a position substantially directly below the cutting edge 21*a* of the fixed blade 21. When the recording paper 10*a* is conveyed between these cutting edges 21*a* and 22*a* (the paper cutting position), the movable blade 22, which is on the bottom, is pivoted upwards so that the cutting edges 21*a* and 22*a* close together widthwise to the printer and cut the recording paper 10*a* located therebetween.

Figure 4:
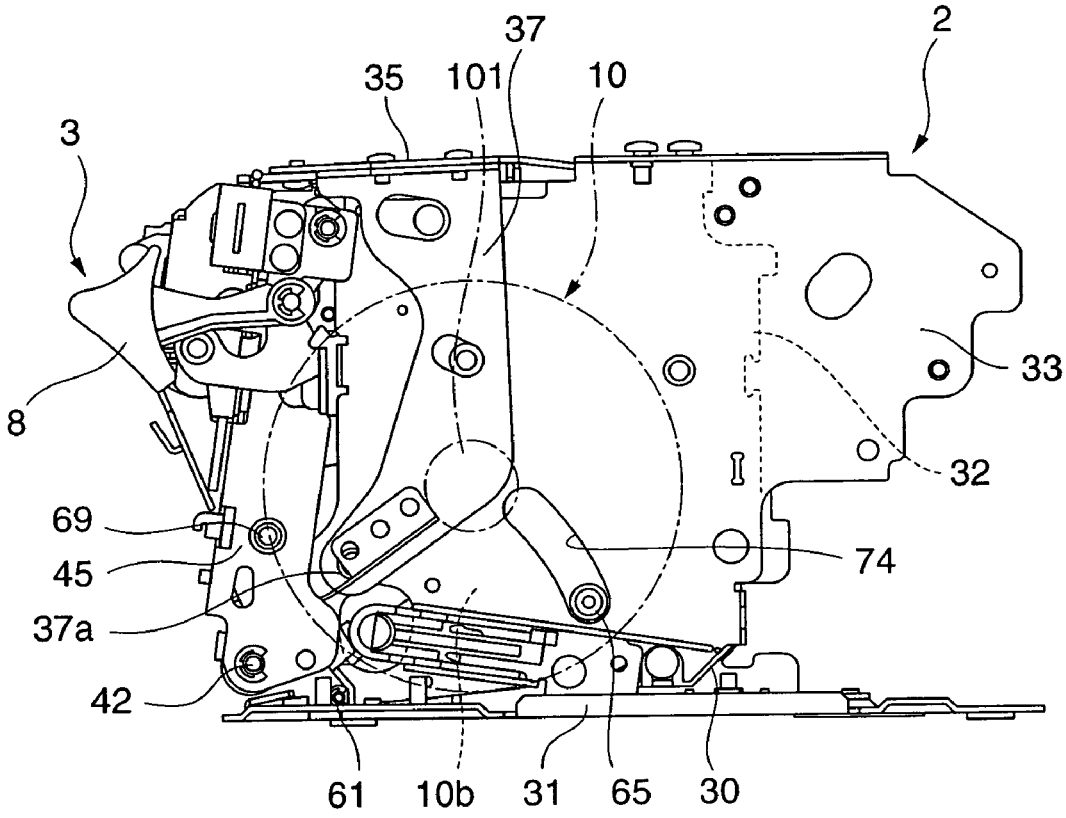
FIG. 4 is a side view of the roll paper printer with the operable cover unit and the printer case removed.
Figures 5A, 5B:
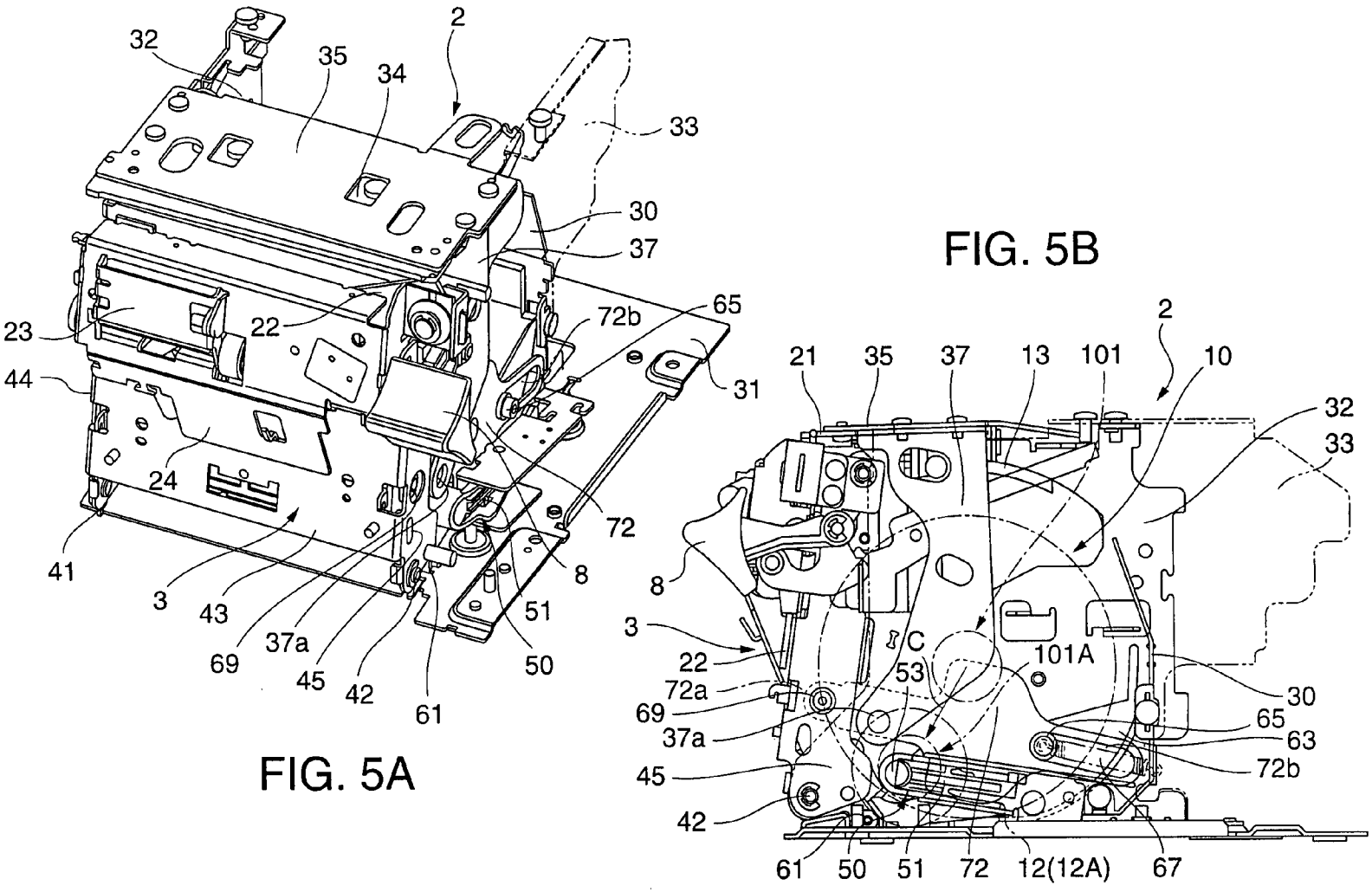
FIG. 5A and FIG. 5B are an oblique view and side view, respectively, of the roll paper printer with one side panel shown in FIG. 4 removed to describe the internal structure.
Figures 6A, 6B:
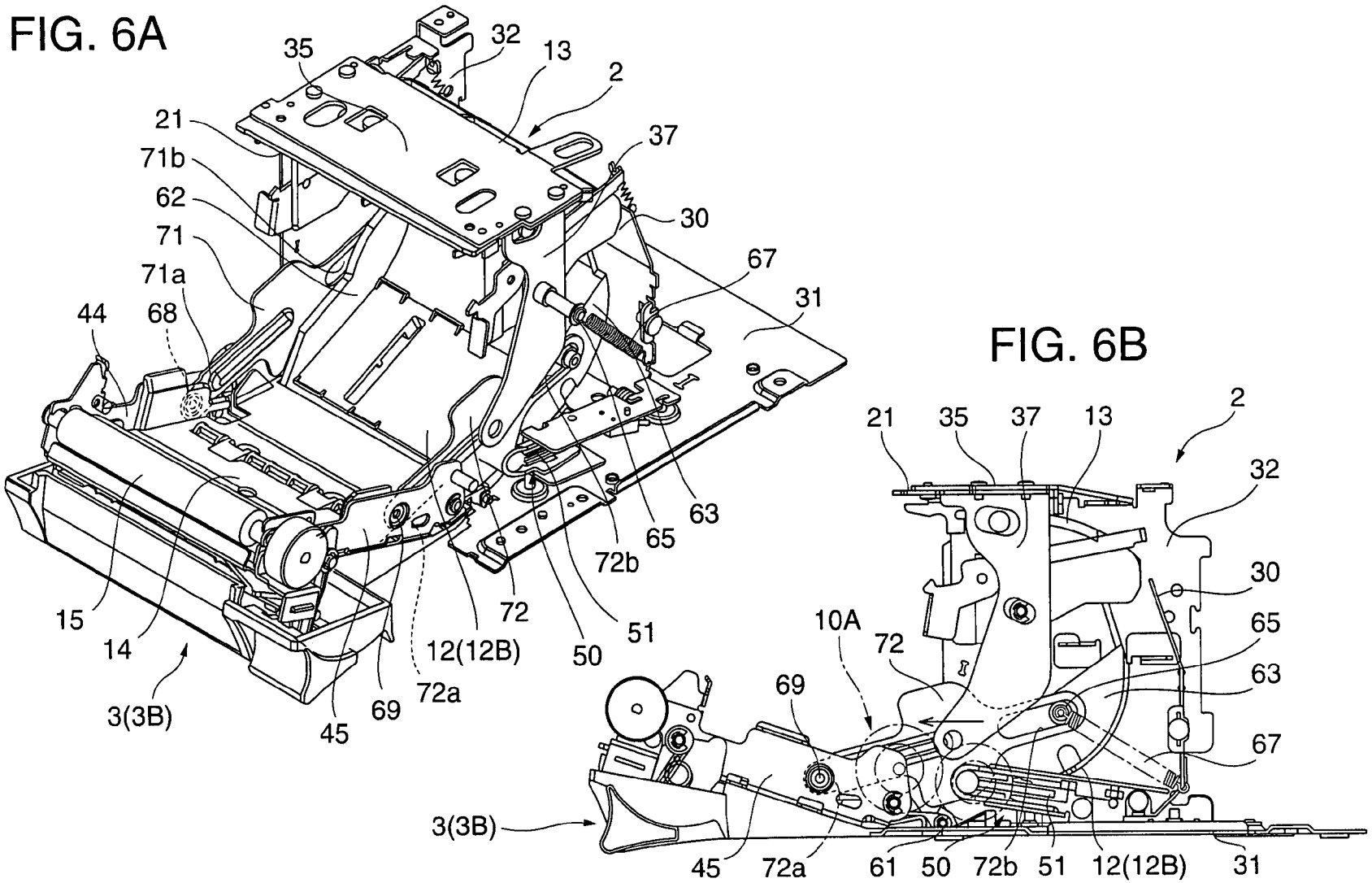
FIG. 6A and FIG. 6B are an oblique view and side view, respectively, of the roll paper printer with the operable cover unit open.

FIG. 4 is a side view showing the mechanical part of the roll paper printer 1 with the printer case 6 and the operable cover case 7 removed. FIG. 5A and FIG. 5B are an oblique view and a side view, respectively, with one side panel removed as denoted by the imaginary line to show the internal structure. FIG. 6A and FIG. 6B are an oblique view and side view, respectively, similar to FIG. 5 but with the operable cover unit open.

The roll paper printer 1 is further described with reference to these figures.

The printer chassis 2 has a base panel 31 defining the printer bottom, right and left side panels 32 and 33 rising vertically from the base panel 31 with a specific gap therebetween, and a back panel 30 disposed between the back of these right and left side panels 32 and 33 widthwise to the printer. A head mounting panel 34 is disposed horizontally widthwise to the printer across the gap between the top portions of the side panels 32 and 33. The thermal print head 16 is mounted to the bottom of the head mounting panel 34 with the head surface 16*a* facing down and substantially horizontal (see FIG. 3). The top panel 13 of the roll paper compartment 9 is located below the back part of the head mounting panel 34. The bottom panel 12 of the roll paper compartment 9 is located on top of the base panel 31.

A fixed blade mounting plate 35 is disposed horizontally widthwise to the printer above the head mounting panel 34. The fixed blade 21 of the paper cutting device 20 is attached substantially horizontally and facing forward at the front bottom part of the fixed blade mounting plate 35. The fixed blade mounting plate 35 is disposed between the top edges of the right and left pivot plates 36, 37 (only pivot plate 37 is shown in the figures), which are located outside of the side panels 32 and 33. The pivot plates 36, 37 can pivot (move) slightly in the longitudinal (front to back) direction of the printer on the bottom end portions 36*a*, 37*a* (only bottom portion 37*a* is shown in the figures) of the pivot plates 36, 37. When the paper cutting device 20 cuts the recording paper 10*a*, the movable blade 22 pivots up from below while pushing (moving) the fixed blade 21 to the back so that the cutting edges 21*a* and 22*a* contact at a point and cut the recording paper 10*a*. The pivot plates 36, 37 support the fixed blade 21 so that the fixed blade 21 retracts slightly while cutting the paper.

A roll paper size detection mechanism 50 for detecting when the supply of roll paper 10 held in the roll paper compartment 9 has decreased to or below a predetermined amount is assembled to the bottom end portion on the outside of the side panel 33.

The operable cover unit 3 can open to a predetermined angle to the front of the printer pivoting on support pins 41, 42 affixed at the bottom end part of the side panels 32 and 33 of the printer chassis 2. The operable cover unit 3 has a front panel portion 43 and narrow side panel portions 44 and 45 formed by bending the right and left edges of the front panel portion 43 perpendicularly toward the back of the printer. The movable blade 22 and the movable blade drive mechanism 23 of the paper cutting device 20 are disposed to the front of the front panel portion 43, and are covered by a protective panel 24. The front of the protective panel 24 is covered by the operable cover case 7 (see FIG. 3). The platen roller 15 is disposed freely and rotatably between the side panel portions 44 and 45. The front panel 14 of the roll paper compartment 9 affixed to the back side of the front panel portion 43 is located below the platen roller 15.

As described above, the front panel 14 of the roll paper compartment 9, the platen roller 15, and the movable blade 22 of the paper cutting device 20 are mounted in the operable cover unit 3. Opening the operable cover unit 3 opens the roll paper compartment 9 as shown in FIG. 2 and FIG. 5, and opens the paper transportation path from the roll paper compartment 9 past the printing position and paper cutting position to the paper exit 5. Therefore, when a specific length of recording paper 10*a* is pulled from the roll paper 10 inside the roll paper compartment 9 and the operable cover unit 3 is then closed, the recording paper 10*a* is automatically set and threaded through the paper transportation path.

Figure 7B:
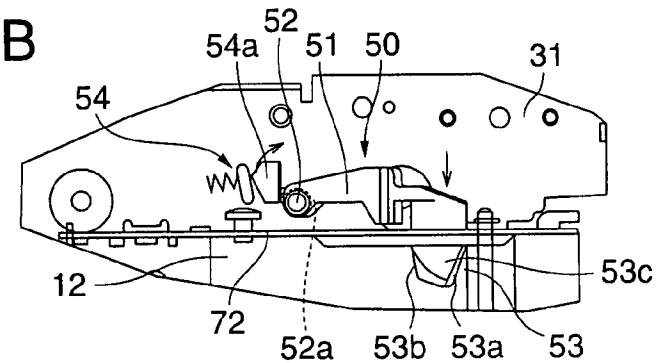
FIG. 7A to FIG. 7C are an oblique view, a plan view, and a side view, respectively, showing the roll paper detection mechanism.
Figure 7C:
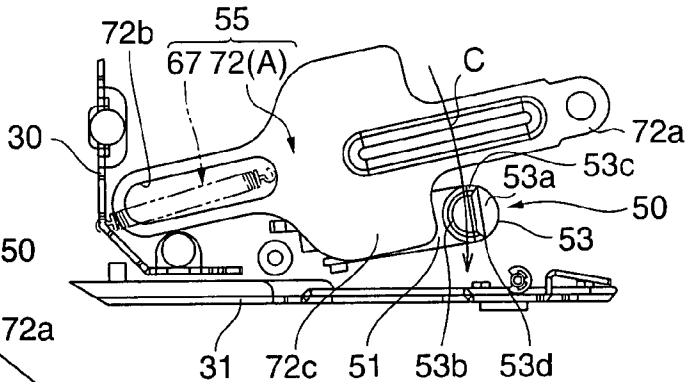
Figure 7A:
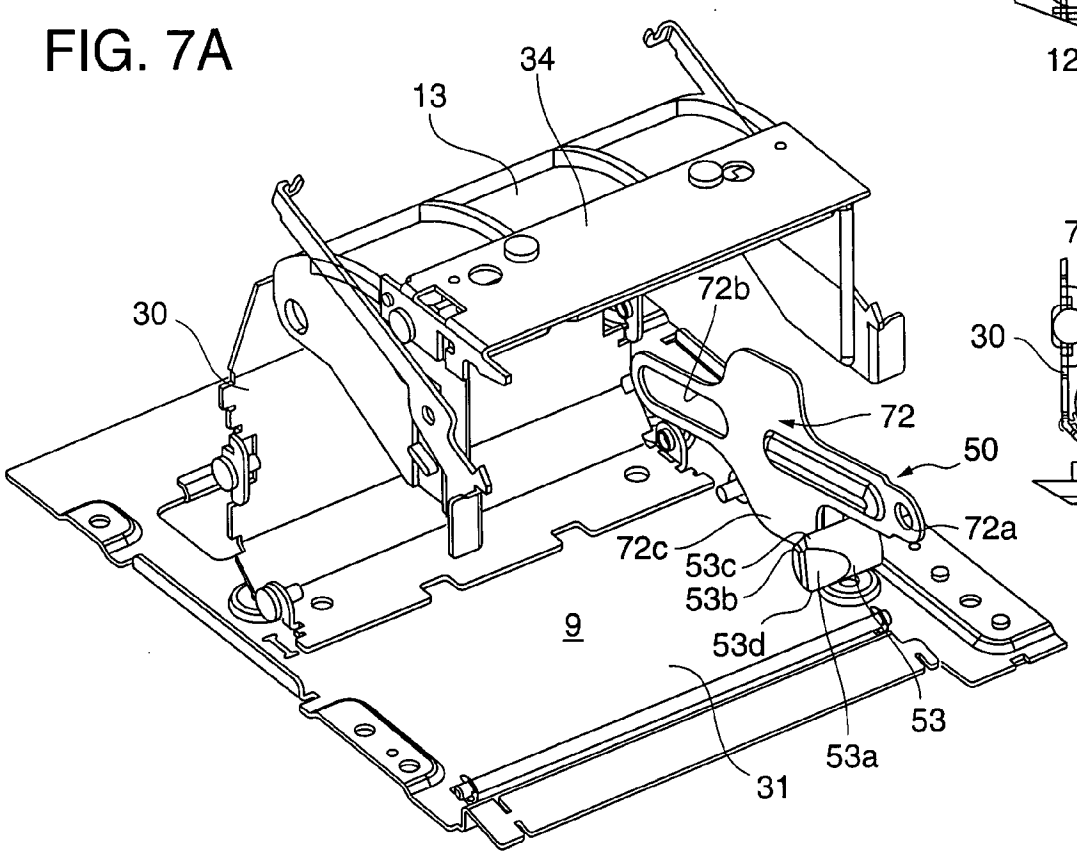
Figure 8B:
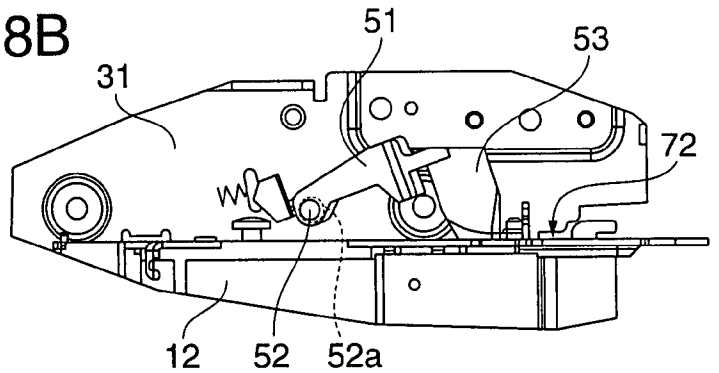
FIG. 8A to FIG. 8C are an oblique view, a plan view, and a side view, respectively, showing the roll paper detection mechanism with the operable cover unit open.
Figure 8C:
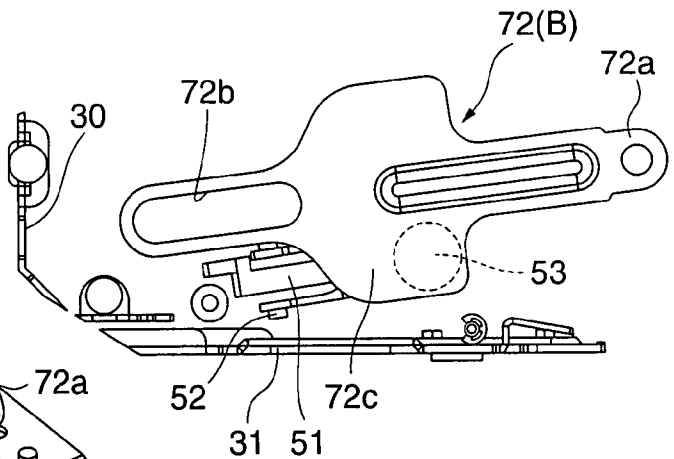
Figure 8A:
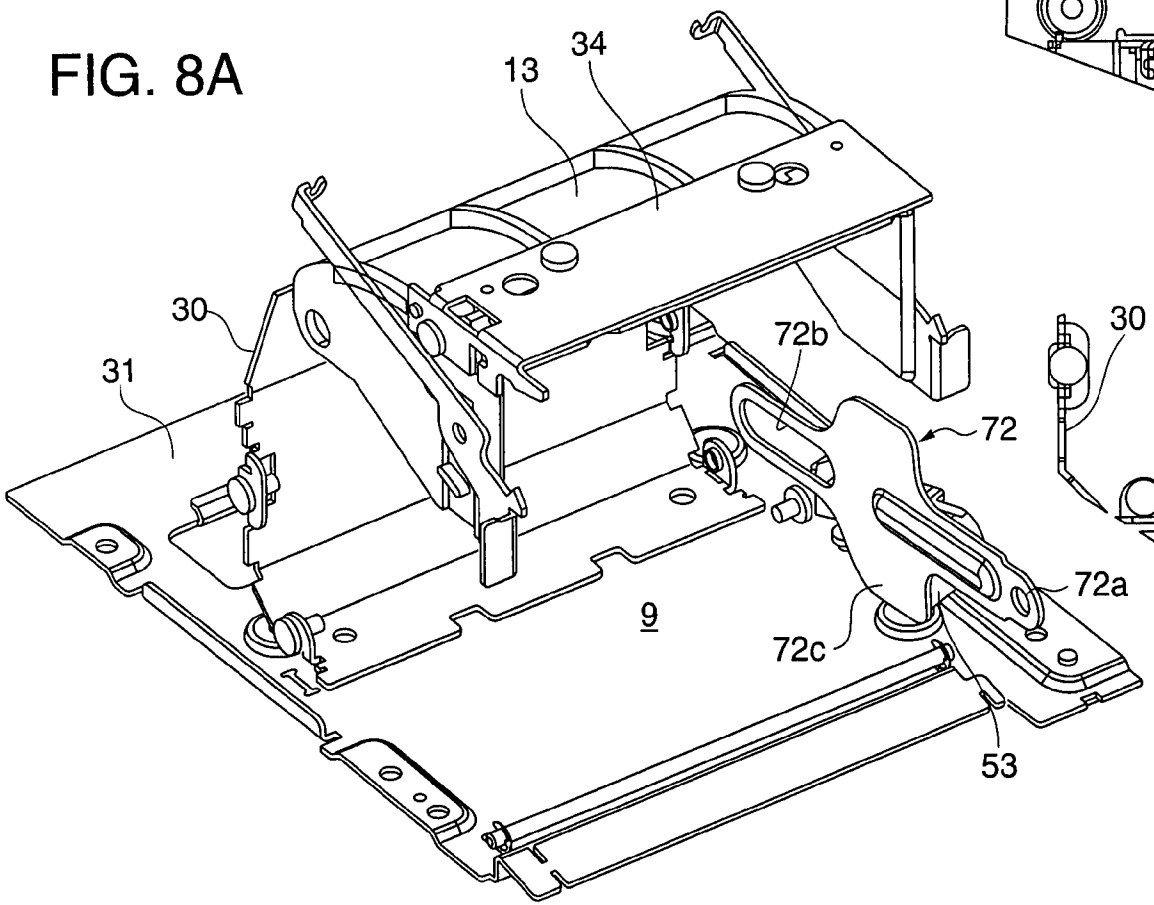

FIG. 7A, FIG. 7B, and FIG. 7C are a partial oblique view, plan view, and side view of the roll paper size detection mechanism 50. FIG. 8A, FIG. 8B, and FIG. 8C are a partial oblique view, plan view, and side view of the roll paper size detection mechanism 50 when the operable cover unit 3 is open.

The roll paper size detection mechanism 50 is described with reference to FIG. 4 to FIG. 8. The roll paper size detection mechanism 50 has a detection lever 51 attached to the outside of the side panel 33 of the printer chassis 2. The end of the detection lever 51 toward the back of the printer can pivot widthwise to the printer on a support stud 52 attached to the side panel 33. A torsion spring 52*a* (urging member) is disposed to the support stud 52, and this torsion spring 52*a* constantly urges the detection lever 51 to the inside widthwise to the printer (the projection direction).

A detection tab 53 projecting to the inside widthwise to the printer is attached to the distal end part of the detection lever 51. The detection tab 53 projects to the inside of the roll paper compartment 9 through an opening not shown in the side panel 33. The bottom panel 12 of the roll paper compartment 9 is inclined slightly to the front, and as the roll paper 10 resting thereon is used (consumed), the diameter gradually decreases and the core hole 101 therefore gradually descends to the front. When the diameter of the roll paper 10 decreases to a predetermined size, the core hole 101 of the roll paper 10A reaches a position 101A containing the position where the detection tab 53 protrudes.

Until the diameter of the roll paper 10 decreases to the predetermined size, the detection tab 53 is held pressed against the round end 10*b* (side) of the roll paper 10 held in the roll paper compartment 9. When the core hole 101 of the roll paper 10 descends to a predetermined height, which is the position where the detection tab 53 protrudes, the detection tab 53 enters the core hole 101.

The base end of the detection lever 51 is linked to one switching part 54*a* of the detection switch 54. The detection switch 54 is off when the detection tab 53 is pressed against the round end 10*b* of the roll paper 10. When the detection tab 53 is inserted to the core hole 101 of the roll paper 10, the detection lever 51 pivots and the detection switch 54 linked to the back end of the detection lever 51 turns on. A control unit not shown detects output (change) from the detection switch 54, and knows that the diameter of the roll paper 10 has dropped to a predetermined size, there is little recording paper 10*a* left, and the roll paper 10 will soon need replacing.

The roll paper size detection mechanism 50 according to this embodiment of the invention has a detection lever retraction mechanism 55 for unconditionally retracting the detection tab 53 of the detection lever 51 protruding into the roll paper compartment 9 from the roll paper compartment 9 in conjunction with opening the operable cover unit 3.

The detection lever retraction mechanism 55 according to this embodiment of the invention has a link bar 72 that moves reciprocally between a retreated position (first position) A separated from the detection tab 53 and an advanced position (second position) B pushing the detection tab 53 in the retraction direction. A tension spring 67 (urging member) pulls the link bar 72 to the retreated position A.

The distal end part 72*a* of the link bar 72 is linked to rotate freely on a support pin 69 affixed to the side panel 45 of the operable cover unit 3. A long straight slot 72*b* is formed in the front-to-back (longitudinal) direction of the printer in the back portion of the link bar 72. A slide pin 65 affixed to the side wall part 63 of the bottom panel 12 of the roll paper compartment 9 is slidably inserted in the slot 72*b*. The tension spring 67 is stretched between the slide pin 65 and a position on the bottom end of the back panel 30 of the printer chassis 2.

Opening and closing the operable cover unit 3 causes the link bar 72 to move bidirectionally longitudinally to the printer between the retreated position A (FIGS. 7A-7C) and the advanced position B (FIGS. 8A-8C). A wide portion is formed in the middle part of the link bar 72, and a contact plate part 72*c* extending toward the bottom moves along a path passed the position where the detection tab 53 protrudes. When the link bar 72 is in the retreated position A (when the operable cover unit 3 is in the closed position 3A shown in FIG. 1), the contact plate part 72*c* is offset to the back side of the detection tab 53 as shown in FIG. 7B and FIG. 7C. When the link bar 72 then moves to the advanced position B, the detection tab 53 is pushed to the outside by the contact plate part 72*c*, contacts the outside of the contact plate part 72*c*, and the detection tab 53 is thus held in the retracted position by the contact plate part 72*c*, as shown in FIGS. 8A-8C. When the operable cover unit 3 closes from the open position 3B, the link bar 72 also returns from the advanced position B to the retreated position A, the detection tab 53 separates from the contact plate part 72*c*, and thus again protrudes into the roll paper compartment 9.

The detection tab 53 of the detection lever 51 is thus retracted from the roll paper compartment 9 in conjunction with opening the operable cover unit 3. The detection tab 53 is thus removed from inside the roll paper compartment 9 when replacing the roll paper 10, and the detection tab 53 is therefore prevented from contacting the roll paper 10 and interfering with roll paper 10 replacement.

Because the detection tab 53 is thus retracted, there is no need to form a tapered or sloped surface on the distal end part of the detection tab 53 to facilitate pushing the detection tab 53 out of the way when replacing the roll paper. Furthermore, because a taper or inclined surface can be omitted, the detection precision of the detection tab 53 can also be improved.

Note that as shown in FIGS. 7A-7C, tapers 53*a* and 53*b* located toward the front and back of the printer are formed on the outside surface of the distal end of the overall cylindrically shaped detection tab 53. The front taper 53*a* is provided to prevent interference with the edge of the opening not shown in the side panel 33, and the back taper 53*b* is provided to facilitate being pushed by the contact plate part 72*c* of the link bar 72. A taper is not formed on the outside surfaces 53*c* and 53*d* perpendicular to tapers 53*a* and 53*b*, that is, on the sides in the direction of movement of the core hole 101 of the roll paper 10 (arrow C in FIG. 5B and FIG. 7C). Because tapers are not formed on either side in roll paper detection direction, detection precision can be improved compared with arrangements having tapers on these surfaces.

In the roll paper compartment 9 of the roll paper printer 1 according to this embodiment of the invention, the bottom panel 12 changes from a substantially horizontal posture to a forward sloping posture in conjunction with opening and closing the operable cover unit 3. When the operable cover unit 3 opens, the bottom panel 12 slopes forward and the roll paper 10 resting on the bottom panel 12 rolls forward due to its own weight. In this embodiment of the invention a mechanism for ejecting the roll paper 10 is comprised using parts (including the link bar 72 and tension spring 67) of the detection lever retraction mechanism 55 as further described below.

This roll paper ejection mechanism is described with reference primarily to FIG. 3, FIG. 5A, FIG. 5B, FIG. 6A, and FIG. 6B. The bottom panel 12 rests on the base panel 31 so that the front end side can move circularly freely in the front-to-back direction of the printer on support pin 61. Slide pins 64, 65 (only slide pin 65 is shown in the figures) are affixed protruding to the sides at the back of side wall parts 62, 63 on both sides of the bottom panel 12.

Tension springs 66 and 67 (only tension spring 67 is shown in the figures) are stretched and attached between these slide pins 64, 65 and a place at the bottom end of the back panel 30. These left and right tension springs 66 and 67 hold the bottom panel 12 in a substantially horizontal position 12A in contact with the base panel 31.

Identically shaped flat link bars 71 and 72 are disposed between these slide pins 64, 65 and a vertically center part of the left and right side panel portions 44 and 45 of the operable cover unit 3. The distal end parts 71*a* and 72*a* of the link bars 71 and 72 are connected to support pins 68 and 69 so that the link bars 71 and 72 can pivot freely to the printer. Long straight slots 71*b* and 72*b* are formed in the front-to-back direction of the printer in the back end part of the link bars 71 and 72, and the slide pins 64, 65 are inserted to slide freely in these slots. These slide pins 64, 65 are also inserted to arc-shaped guide holes 73 and 74 (only guide hole 74 is shown in the figures) formed in the left and right side panels 32 and 33 as shown in FIG. 4. These guide holes 73 and 74 are arcs of which the center is support pin 61. When the bottom panel 12 pivots on support pin 61, the slide pins 64, 65 move along these guide holes 73 and 74.

Operation of the roll paper ejection mechanism thus rendered in the roll paper compartment 9 is described next.

When the operable cover unit 3 is closed, the left and right slide pins 64, 65 of the bottom panel 12 are positioned at the front end of the slots 71*b* and 72*b* in the left and right link bars 71 and 72. As shown in FIG. 4, the slide pins 64, 65 are positioned at the bottom end of the arc-shaped guide holes 73 and 74.

When the operable cover unit 3 opens, the left and right link bars 71 and 72, of which the front ends are linked to the left and right side panel portions 44 and 45 of the operable cover unit 3, also move forward. The left and right slide pins 64, 65 attached to the bottom panel 12 of the roll paper compartment 9 are positioned at the front end of the slots 71*b* and 72*b* in the link bars 71 and 72. The bottom panel 12 does not move until the link bars 71 and 72 move forward a predetermined distance and the back ends of these slots 71*b* and 72*b* contact the slide pins 64, 65.

After the slide pins 64, 65 contact the back ends of the slots 71*b* and 72*b*, the left and right link bars 71 and 72 pull the slide pins 64, 65 forward as the operable cover unit 3 continues to open. As a result, the bottom panel 12 to which these slide pins 64, 65 are attached can move circularly on the support pin 61 at the front, and thus swings forward on the support pin 61 in conjunction with opening the operable cover unit 3.

As shown in FIG. 6, when the operable cover unit 3 is in the fully open position at open position 3B, the bottom panel 12 is inclined a predetermined angle in the forward inclined position 12B. As a result, the bottom panel 12 changes from the substantially horizontal position 12A to the forward inclined position 12B in conjunction with opening the operable cover unit 3. When the roll paper 10 is on the bottom panel 12, the weight of the roll paper 10 causes the roll paper 10 to roll forward on the bottom panel 12 in this forward inclined position 12B. As a result, the roll paper 10 having little remaining recording paper 10*a* is ejected to the front as denoted by the imaginary lines in FIG. 6. The roll paper 10 can therefore be easily removed from the top front of the open operable cover unit 3.

After the bottom panel 12 starts to pivot, the operable cover unit 3 is pulled to the back by the left and right tension springs 66 and 67 by means of the intervening link bars 71 and 72. The tension of the tension springs 66 and 67 thus prevents the operable cover unit 3 from opening suddenly to the front when the operable cover unit 3 is opened, and thus prevents damage resulting from the operable cover unit 3 hitting the surface on which the printer is placed with great force.

When the operable cover unit 3 is then closed, the link bars 71 and 72 also move to the back in conjunction with the operable cover unit 3 closing. The forward tension on the left and right slide pins 64, 65 of the bottom panel 12 is thus released, and the force of the tension springs 66 and 67 returns the bottom panel 12 to the original substantially horizontal position 12A. As a result, the roll paper 10 resting on the bottom panel 12 is stored in the predetermined position.

Second Embodiment

A roll paper printer according to a second embodiment of the invention is described next with reference to FIG. 9 to FIG. 16.

Figure 9:
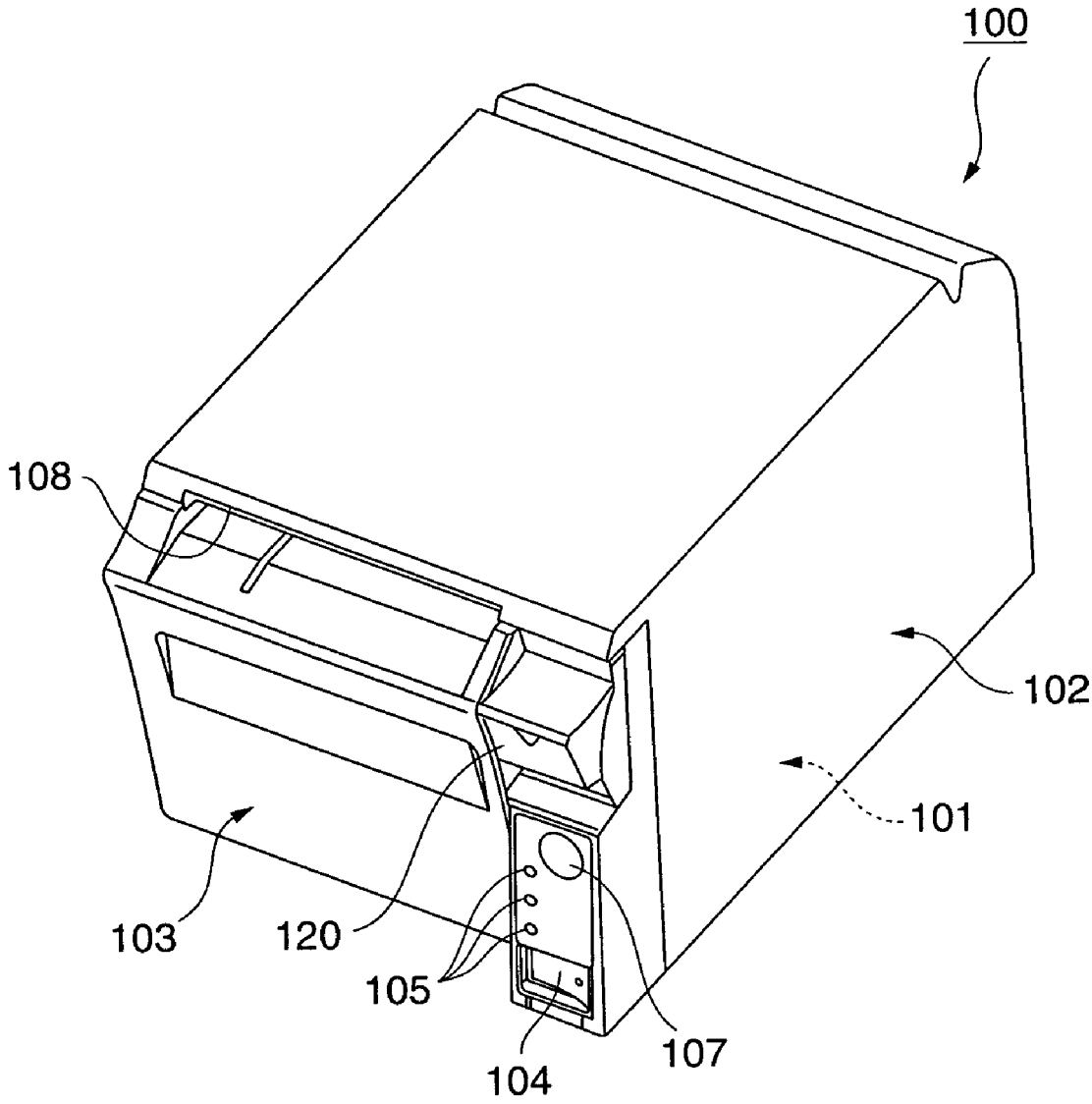
FIG. 9 is an oblique view of a roll paper printer according to a second embodiment of the invention.
Figure 10:
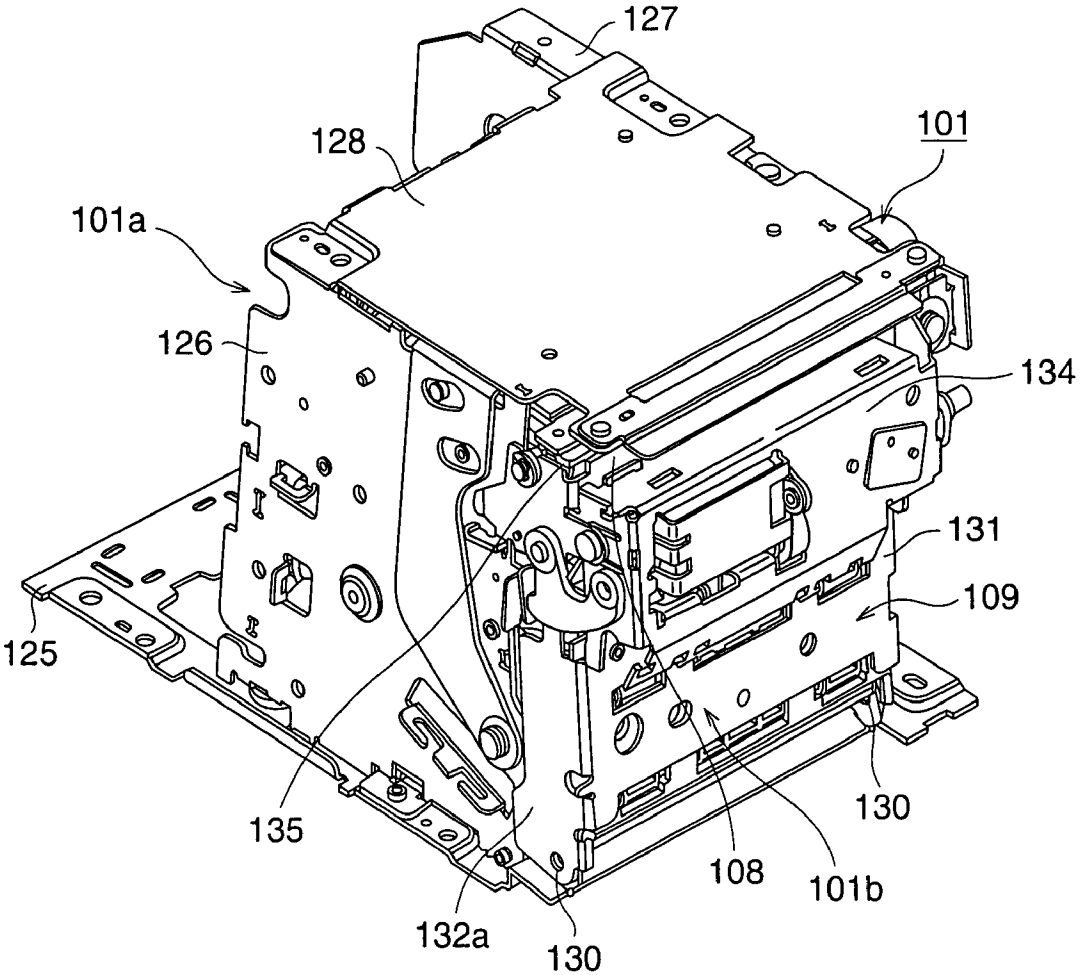
FIG. 10 is an oblique view of the printer mechanism part as seen from the left front.
Figure 11:
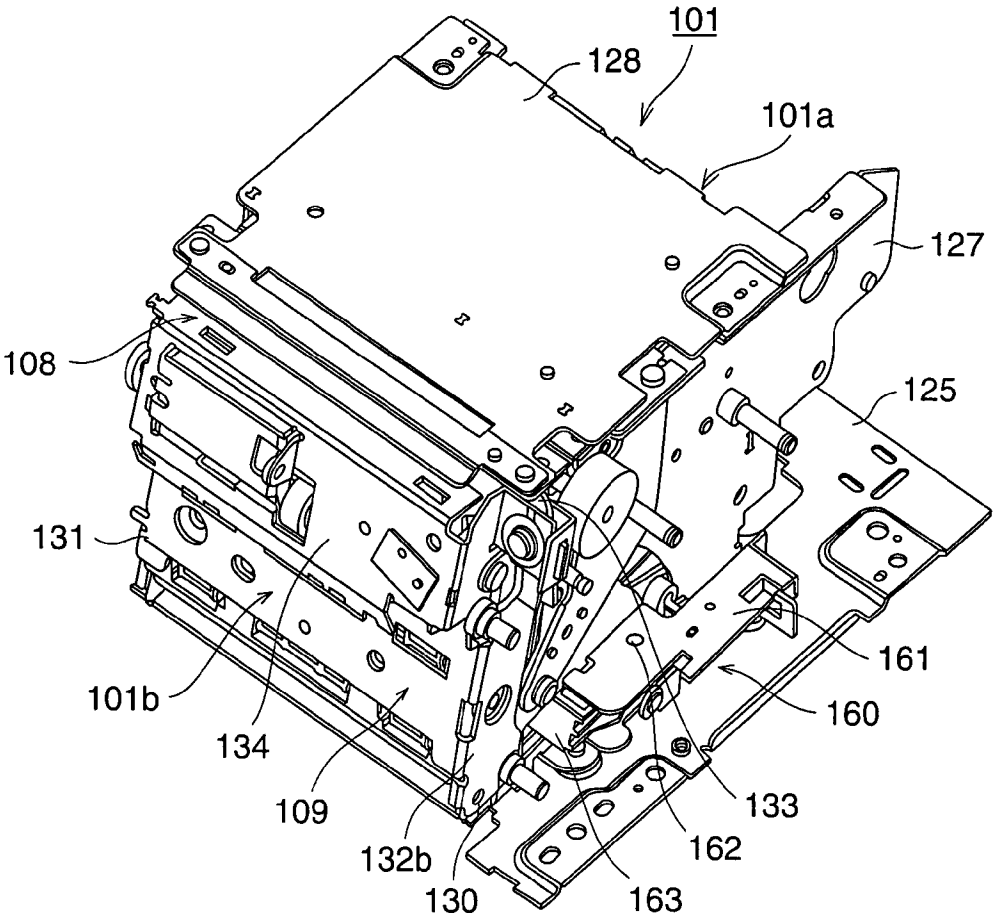
FIG. 11 is an oblique view of the printer mechanism part as seen from the right front.
Figure 12:
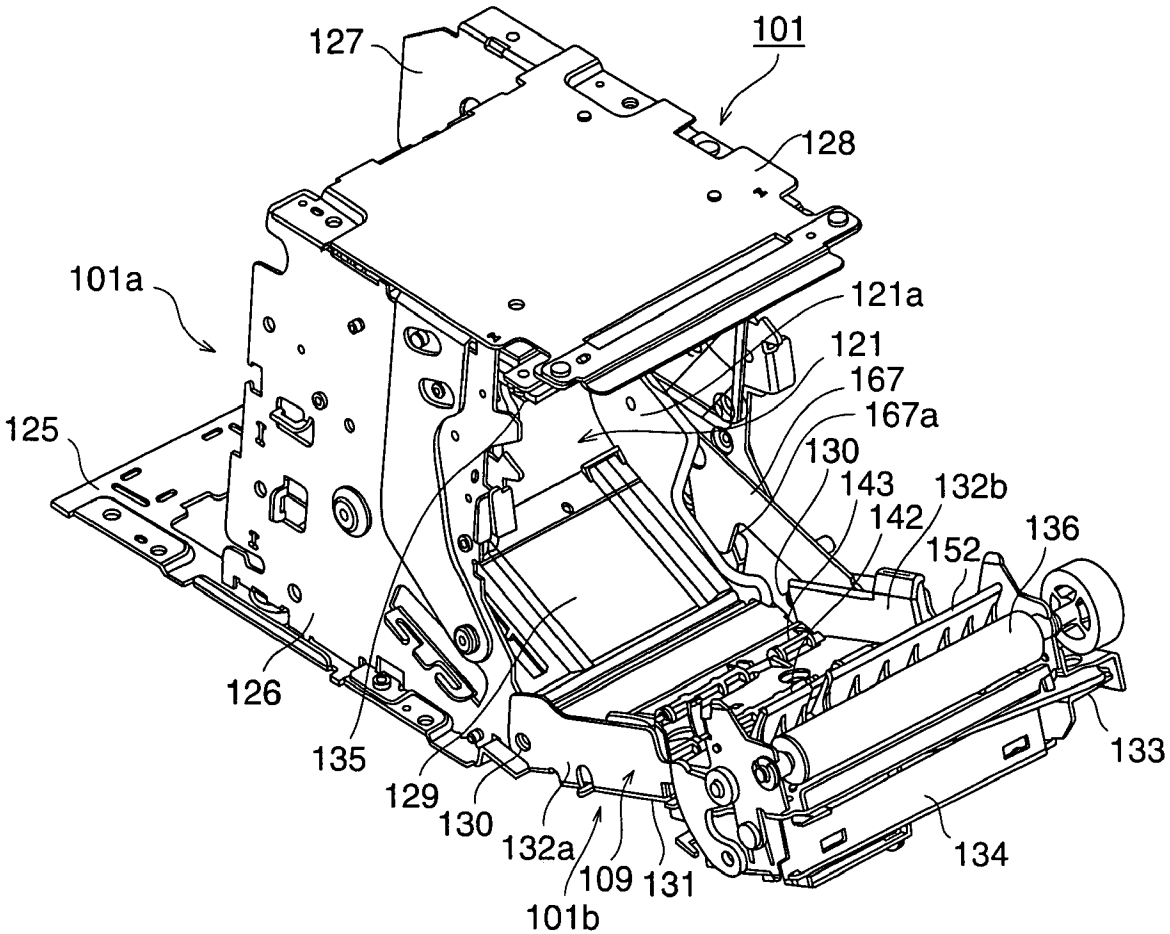
FIG. 12 is an oblique view of the printer mechanism part with the operable cover unit open.
Figure 13:
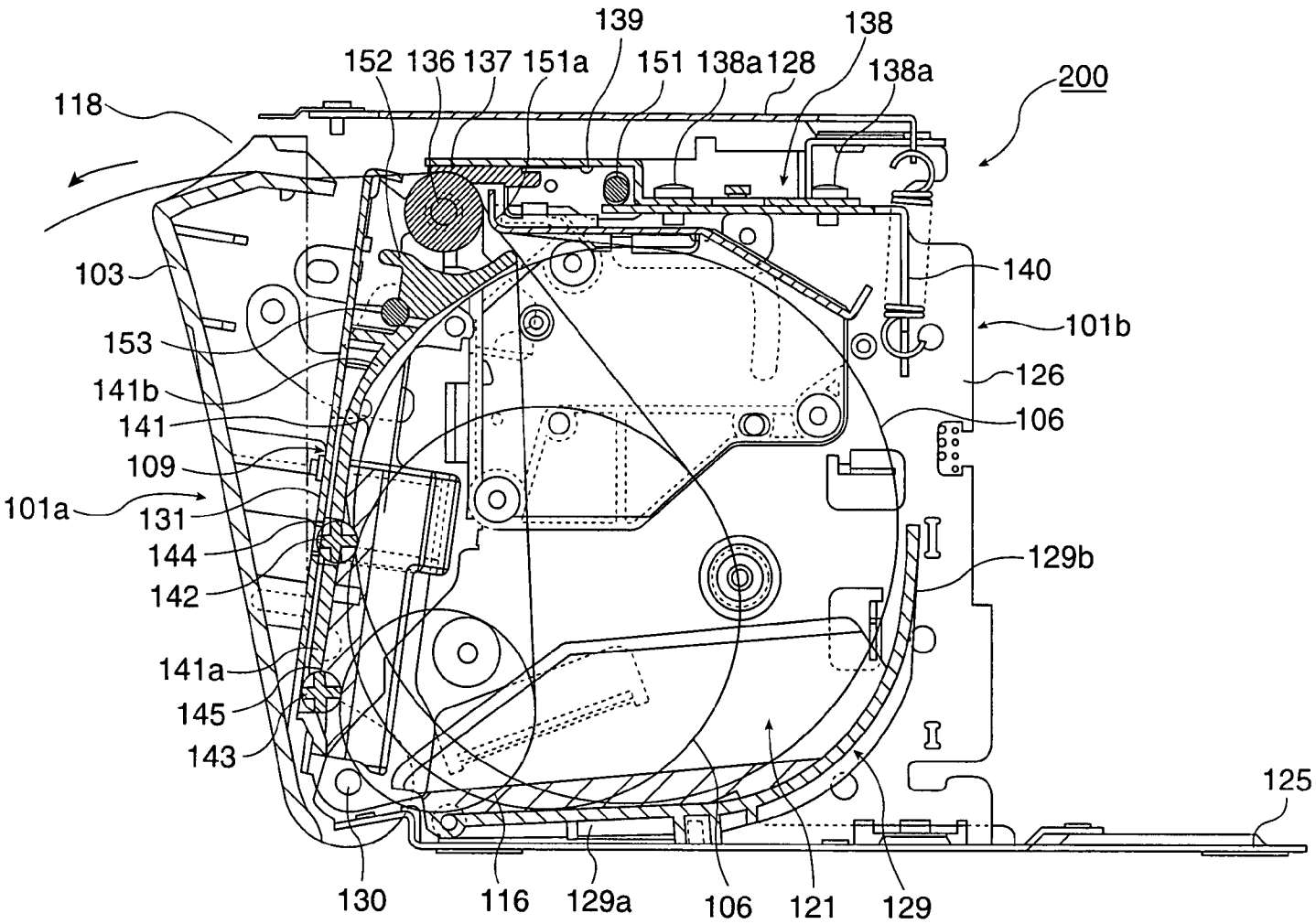
FIG. 13 is a schematic section view of the printer mechanism part.

FIG. 9 is an external oblique view of the roll paper printer, FIG. 10 is an oblique view of the printer mechanism part as seen from the front left, FIG. 11 is an oblique view of the printer mechanism part as seen from the front right, FIG. 12 is an oblique view of the printer mechanism part when the operable cover unit is open, and FIG. 13 is a schematic diagram showing the internal arrangement of the roll paper printer.

A roll paper printer 100 according to this embodiment of the invention has a printer mechanism unit 200, a printer case 102 covering substantially all of the printer mechanism unit 200, and an operable cover case 103 covering the front of the printer mechanism unit 200 that is not covered by the printer case 102. A paper exit 108 extending widthwise to the operable cover case 103 is formed at the top part of the operable cover case 103.

The printer case 102 covers part of the front, the top, the right and left sides, and the back of the printer mechanism unit 200 (see FIG. 13). Disposed at the front of the printer case 102 are a power switch 104 for turning the roll paper printer 100 power on and off, a state indicator group 105 for reporting the operating state of the roll paper printer 100, and a feed button 107 that is used to feed the roll paper 106 held inside the roll paper printer 100.

The printer mechanism unit 200 comprises a printer chassis 101*a* and an operable cover unit 101*b*. The operable cover unit 101*b* comprises the operable cover 109 and the operable cover case 103 attached to the front of the operable cover 109. The operable cover unit 101*b* is connected by a hinge at the front bottom part of the printer mechanism unit 200, and can swing forward and open on this hinge. Operating the operating lever 120 disposed at the front of the printer case 102 releases a cover lock not shown and enables the operable cover 109 to swing on the bottom end part of the operable cover 109 from the closed position shown in FIG. 10 and FIG. 11 to the open position shown in FIG. 12. When the operable cover 109 opens, the roll paper loading opening 121*a* at the front of the roll paper compartment 121 formed inside the printer chassis 101*a* is opened as shown in FIG. 12 so that the roll paper 106 can be replaced. The roll paper 106 is generally a tape of recording paper (thermal paper in this embodiment of the invention) wound into a roll on a core.

As shown in FIG. 10, FIG. 11, and FIG. 12, the printer chassis 101*a* has a base panel 125, right and left side panels 126 and 127 rising vertically from the right and left sides of the base panel 125, a back panel (not shown in the figure) disposed between the back of these right and left side panels 126 and 127 widthwise to the printer, and a top panel 128 disposed horizontally widthwise to the printer between the top portions of the side panels 126 and 127.

A roll paper holder 129 forming the bottom and back of the roll paper compartment 121 extends between the left and right side panels 126 and 127. The operable cover unit 101*b* is affixed on support shaft 130 between the front ends of the left and right side panels 126 and 127 so that the operable cover unit 101*b* can pivot open on the support shaft 130.

The operable cover unit 101*b* has a front panel portion 131 and side panel portions 132*a* and 132*b* bent at a right angle to the back of the printer from both sides of the front panel portion 131. A paper cutting device 134 having an internal movable blade 133 is disposed to the top outside of the front panel portion 131, and a fixed blade 135 is disposed above the paper cutting device 134 with the paper exit 108 therebetween. The fixed blade 135 is supported by a fixed blade support frame (not shown in the figure) disposed at the top part of the printer chassis 101*a*. The leading end of the roll paper 106 passes between the movable blade 133 and fixed blade 135 at the paper exit 108. To cut the roll paper 106, the movable blade 133 pivots upward to the fixed blade 135 and cuts the roll paper 106 in conjunction with the movable blade 133.

A platen roller 136 is disposed freely rotatably between the top parts of the side panel portions 132*a* and 132*b* of the operable cover unit 101*b* as shown in FIG. 12 and FIG. 13. When the operable cover unit 101*b* is closed, a thermal print head 137 is disposed above the platen roller 136 at a position opposite the platen roller 136 as shown in FIG. 13, and a plurality of resistance heating elements are disposed on the bottom of the thermal print head 137. The roll paper 106 housed in the roll paper compartment 121 is held between the platen roller 136 and thermal print head 137, and is conveyed to the paper exit 108 by rotating the platen roller 136 by means of a motor not shown.

Text and images are printed on the roll paper 106 by heat emitted from the resistance heating elements of the thermal print head 137 as the roll paper 106 passes between the platen roller 136 and thermal print head 137. The thermal print head 137 is located on a head mounting panel 138 disposed below the printer case 102, and this head mounting panel 138 comprises a head support panel 139 for supporting the thermal print head 137, and a spring support panel 140 joined in unison with the head support panel 139 by a screw 138*a*.

As shown in FIG. 13, a first paper guide 151 for guiding the roll paper 106 to the platen roller 136 is disposed below the head mounting panel 138. This first paper guide 151 comprises a curved portion 151*a* of which the distal end portion curves and extends upward. This curved portion 151*a* is proximally behind the platen roller 136. The roll paper 106 curves upward at the curved portion 151*a*, and is then guided to the platen roller 136. This prevents creasing the edge of the roll paper in case force is applied to the roll paper 106 from the side.

A front panel 141 forming the back of the operable cover unit 101*b* is affixed inside the operable cover unit 101*b*. This front panel 141 comprises a base part 141*a* disposed at an angle toward the back of the printer, and a curved part 141*b* continuing from the base part 141*a* and curving to the back. A second paper guide 152 disposed to the top end of the curved part 141*b* contacts and causes the roll paper 106 to curve when the roll paper 106 is consumed to a size at which the roll paper 106 does not contact the first paper guide 151 when the paper is conveyed.

This second paper guide 152 is affixed so that it can pivot on a support pin 153, and is normally urged to the back by an urging member not shown. This second paper guide 152 also prevents creases in the edge of the roll paper.

The roll paper compartment 121 is rendered between the roll paper holder 129 and the front panel 141 of the operable cover unit 101*b*. The roll paper holder 129 comprises a bottom part 129*a* that inclines slightly to the front, and a back part 129*b* that extends curving upward from the back end of the bottom part 129*a*.

The roll paper 106 held in the roll paper compartment 121 is delivered from the back side of the roll through the paper exit 108 located in front of the roll, and is discharged from the front of the roll paper printer 100. As a result, the outside of the roll paper 106 is pushed against the front panel 141 as the roll paper 106 is discharged from the paper exit 108. Regardless of the size of the diameter of the roll, the roll paper 106 can always be supported by the bottom part 129*a* of the roll paper holder 129 and the operable cover unit 10*b*.

A first roller 142 extending widthwise to the printer is disposed on the base part 141*a* of the front panel 141 midway between the top and bottom of the base part 141*a*, and substantially in the center in this embodiment of the invention. A second roller 143 also extending widthwise to the printer is disposed below the first roller 142 at the bottom end part of the base part 141*a* in this embodiment of the invention. More specifically, openings 144 and 145 are rendered widthwise to the printer in the base part 141*a* of the front panel 141, and the shaft parts of these first and second rollers 142 and 143 are supported on the sides of these openings 144 and 145. These first and second rollers 142 and 143 have the same diameter, and the outside circumference surfaces of the rollers protrude beyond the surface of the base part 141*a* of the front panel 141.

As shown in FIG. 13, when the outside diameter of the roll paper 106 is large, specifically when the diameter of the roll paper 106 is between a maximum diameter of approximately 83 mm and approximately 50 mm in this embodiment of the invention, the first roller 142 contacts the roll paper 106 and reduces the rolling resistance of the roll paper 106 rolling inside the roll paper compartment 121.

When the roll paper 106 is consumed so that the diameter of the roll paper 106 is small, the second roller 143 then contacts the outside of the roll paper 106 and likewise reduces the rolling resistance of the roll paper 106 rolling inside the roll paper compartment 121.

When the diameter of the roll paper 106 is small in this embodiment of the invention means that the outside of the roll paper 106 does not contact the first roller 142. More specifically, the diameter of the roll paper 106 is less than approximately 50 mm. These first and second rollers 142 and 143 can assure that the roll paper 106 rolls smoothly regardless of the roll paper 106 diameter as the size of the roll paper 106 gradually becomes smaller. These first and second rollers 142 and 143 are positioned so that at least one roller always contacts the outside of the roll paper 106 as the roll paper 106 diameter decreases and the outside of the roll paper 106 does not directly contact the front panel 141 of the operable cover unit 10*b*.

A roll paper size detection mechanism (near-end detection mechanism) 160 for detecting when the size of the roll paper 106 in the roll paper compartment 121 has decreased to a predetermined size is disposed as shown in FIG. 11 to the right side panel 127 of the printer chassis 101*a*. The roll paper size detection mechanism 160 has a detection lever further described below that is pressed against the round end surface of the roll paper 106, which is pressed to the front panel 141 of the operable cover unit 101*b* of the roll paper compartment 121 during paper transportation. The near-end of the roll paper 106 is detected when the detection lever separates from the outside edge of the round end of the roll paper 106 to the side toward the back of the printer (away from the outside edge).

Figure 14A:
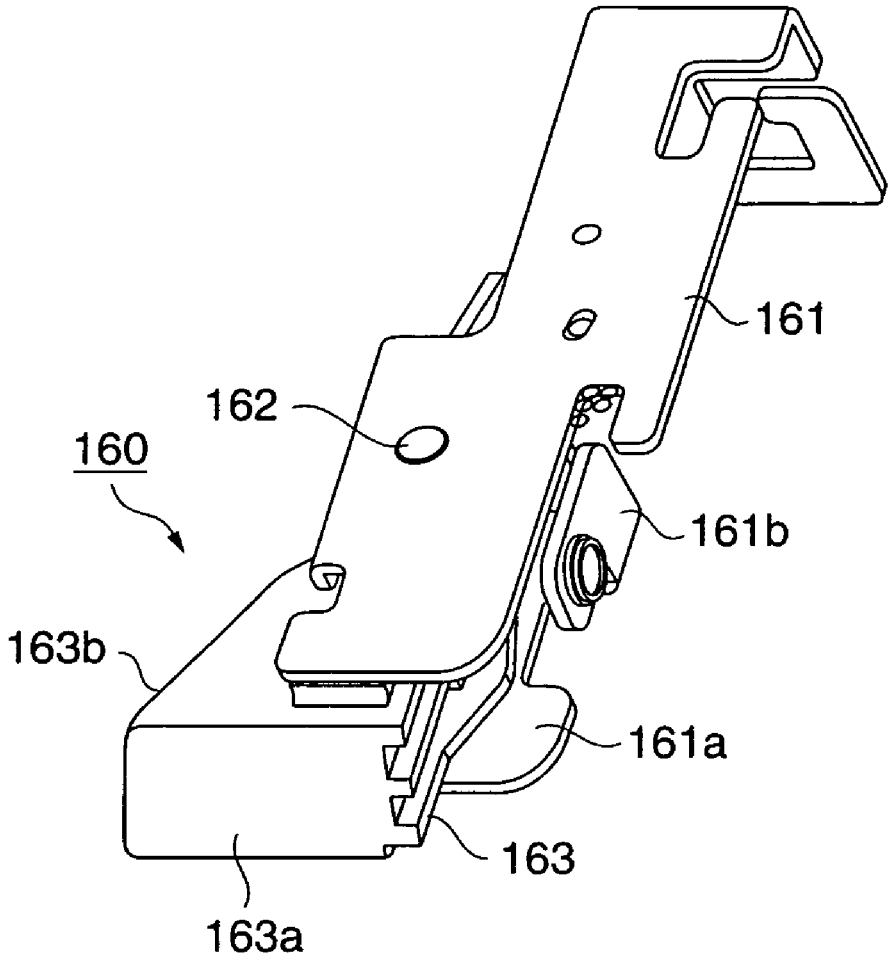
FIG. 14A to FIG. 14C are an oblique view of the roll paper size detection mechanism as seen from above and an oblique view as seen from below, and an oblique view of the detection lever.
Figure 14B:
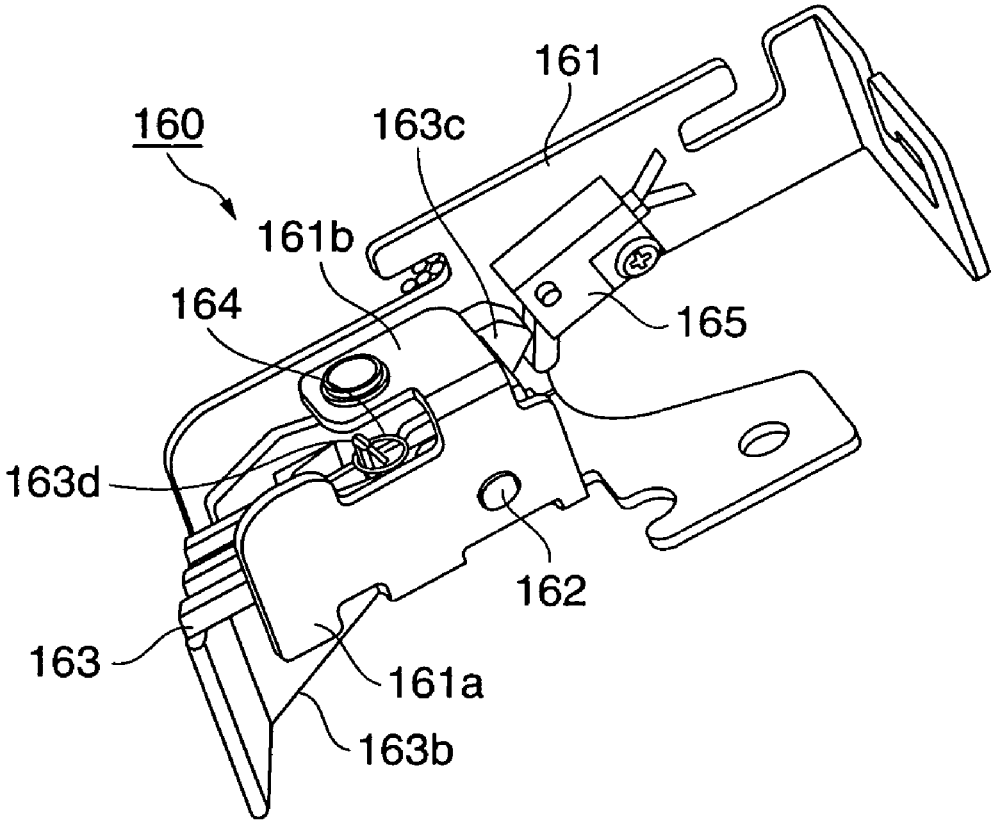
Figure 14C:
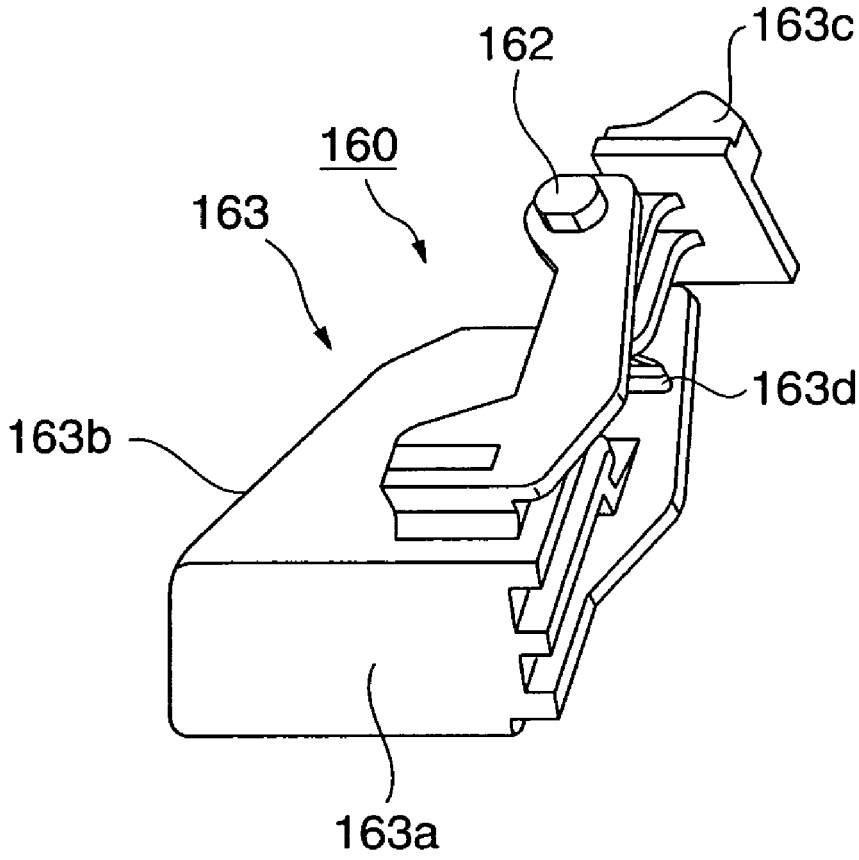

As shown in FIG. 14A to FIG. 14C, the roll paper size detection mechanism 160 comprises a frame 161 fixed to the right side panel 132, a detection lever 163 that is attached to the frame 161 freely pivotally on support pin 162 and is pressed to the round end surface of the roll paper 106 in the roll paper compartment 121, a pressure spring 164 for urging the detection lever 163, and a detection switch 165 that operates according to the pivoting action of the detection lever 163.

The detection lever 163 comprises a tapered surface 163*a* formed on the front end, a contact surface 163*b* formed on the side that is pressed against the round end surface of the roll paper, a rocker part 163*c* formed on the back end part for operating the detection switch 165, and a spring catch 163*d* for holding one end of the pressure spring 164. The contact surface 163*b* is tapered so that the width of the detection lever 163 increases to the front. In other words, the contact surface 163*b* tapers to the back of the printer.

The frame 161 comprises a support part 161*a* that curves in a basic U-shape and supports the detection lever 163, and a spring catch 161*b* formed by bending one end of the support part 161*a* substantially perpendicularly for holding the other end of the pressure spring 164.

Figure 15A:
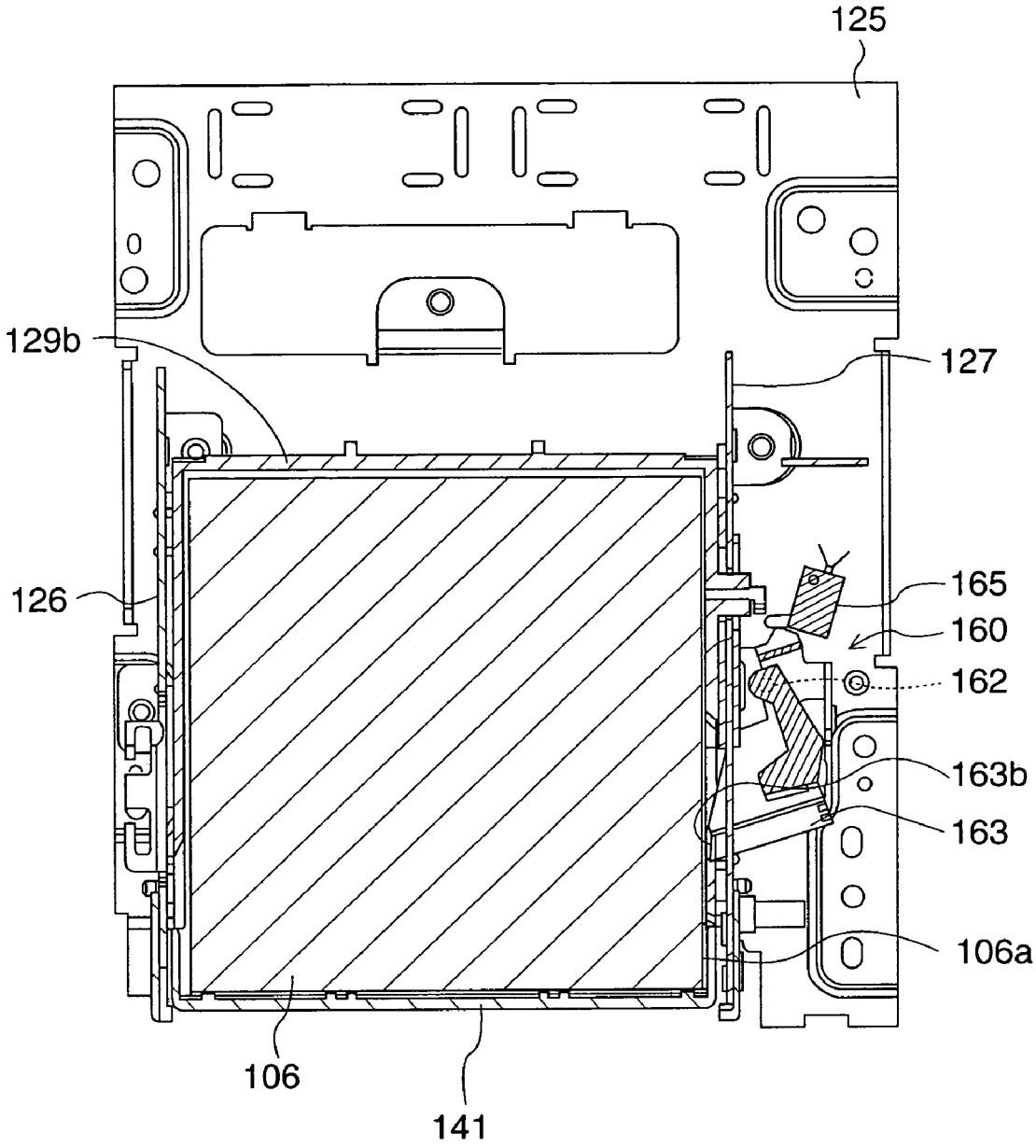
FIG. 15A and FIG. 15B are schematic section views of the printer mechanism part describing the operation of the roll paper size detection mechanism.

The detection operation of this roll paper size detection mechanism 160 is described next with reference to FIG. 15A and FIG. 15B. When the outside diameter of the roll paper 106 is large, the contact surface 163*b* of the detection lever 163 is pressed against the round end surface 106*a* of the roll paper 106 as shown in FIG. 15A. The rocker part 163*c* of the detection lever 163 touches the detection switch 165 at this time (see FIG. 16), and the size of the roll paper is thus known to be greater than a predetermined size.

Figure 15B:
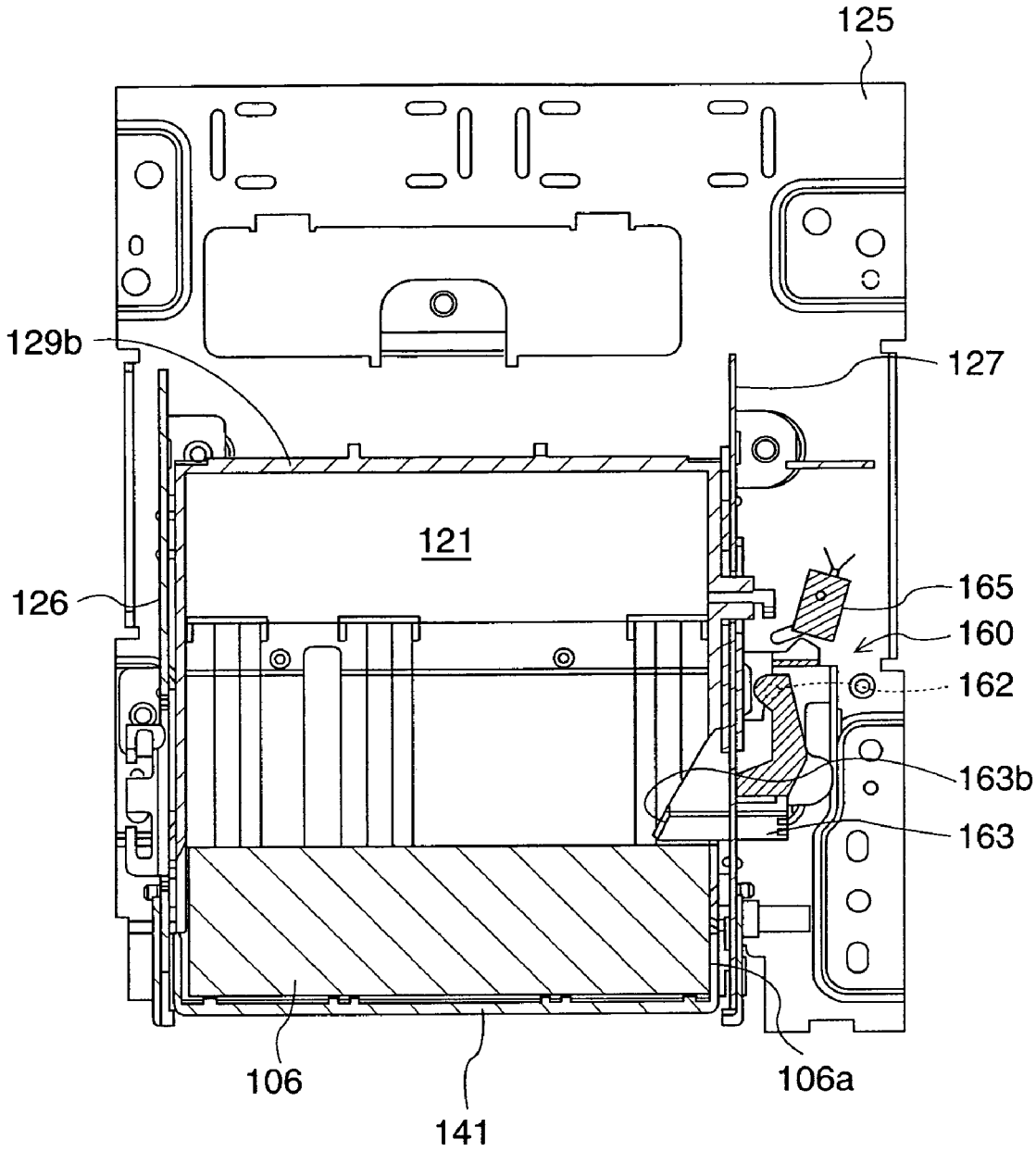

When the diameter of the roll paper 106 becomes small, the force of the pressure spring 164 causes the detection lever 163 to separate from the outside edge of the round end surface 106*a* of the roll paper 106 and move toward the back of the printer (to the outside of the outside edge), and project to the inside of the roll paper compartment 121 as shown in FIG. 15B. As a result, the rocker part 163*c* of the detection lever 163 separates from the detection switch 165. This causes the detection switch 165 to output a near-end state detection signal, that is, an electric signal indicating that the size of the roll paper 106 has decreased to a predetermined size or less.

The function of the contact surface 163*b* (the taper to the back of the printer) formed on the detection lever 163 is described next.

This embodiment of the invention has a detection lever retraction mechanism for retracting the detection lever 163 to outside the roll paper compartment 121 in conjunction with the opening action of the operable cover unit 101*b* when the operable cover unit 101*b* is opened. The contact surface 163*b* functions as a surface engaging the moving plate 167 of the detection lever retraction mechanism.

Figure 16:
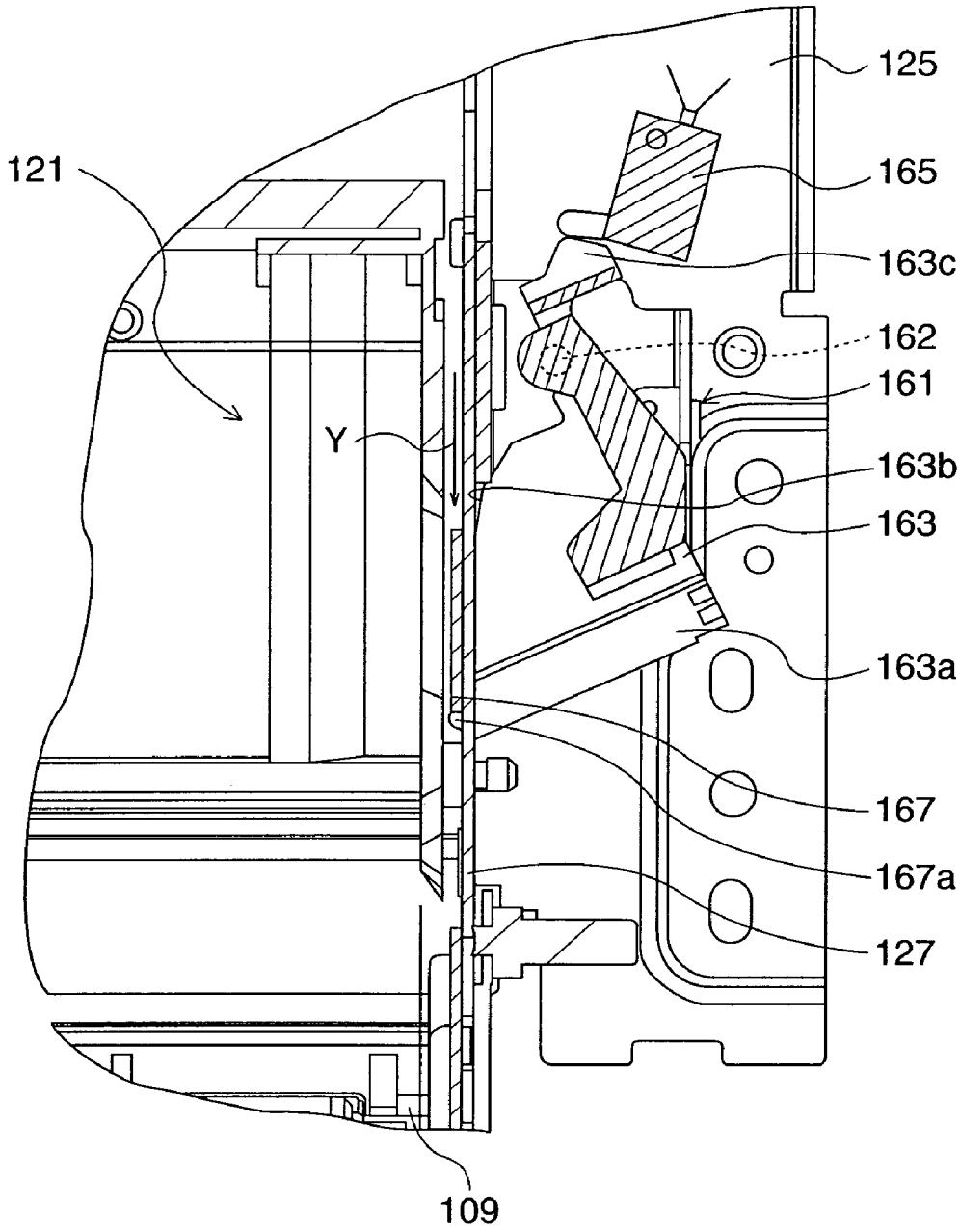
FIG. 16 describes the operation of the detection lever retraction mechanism.

FIG. 16 shows the detection lever retraction mechanism, which is described next with reference to FIG. 12 and FIG. 16. The right side panel 127 of the printer chassis 101*a* and the side panel 132*b* of the operable cover unit 101*b* are linked by this moving plate 167. When the operable cover unit 101*b* opens, the moving plate 167 slides forward (as indicated by arrow Y in the figure) along the right side panel 127. Accompanying this motion, the distal end 167*a* of the moving plate 167 contacts and pushes the contact surface 163*b* of the detection lever 163 to the outside of the roll paper compartment 121. As a result, when the operable cover unit 101*b* opens, the detection lever 163 is retracted to the outside of the roll paper compartment 121.

The detection lever 163 therefore does not protrude into the roll paper compartment 121 when the operable cover unit 101*b* is open, and the roll paper 106 can be easily replaced or the roll paper 106 can be easily removed and inserted.

When the roll paper 106 moves to the back inside the roll paper compartment 121 and the detection lever 163 separates from the round end surface 106*a* of the roll paper 106 (so that the detection lever 163 protrudes), the contact surface 163*b* functions as a guide surface for returning the detection lever 163 to the position pressing against the round end surface 106*a*.

More specifically, when the roll paper 106 moves forward inside the roll paper compartment 121 from the back, the contact surface 163*b* of the detection lever 163 is pushed smoothly out by the outside edge portion of the roll paper 106. As a result, the contact surface 163*b* can again contact the round end surface 106*a* of the roll paper 106. This means that even if vibration, for example, causes the roll paper 106 to roll forward and back inside the roll paper compartment 121, the return of the roll paper 106 to the predetermined position enables continuing to detect when the roll paper 106 has decreased to the predetermined small size.

The near-end of the roll paper 106 is detected when the tapered surface 163*a* separates from the round end surface 106*a* of the roll paper 106. However, because the roll paper 106 may simply be moving inside the roll paper compartment 121, the near-end detection is preferably confirmed only after the near-end signal is output continuously for a predetermined time (such as 10 seconds).

As described above, the detection lever 163 is retracted from the roll paper compartment 121 when the operable cover unit 101*b* opens, and closing the operable cover unit 101*b* causes the detection lever 163 to protrude into the roll paper compartment 121. In this case, the detection lever 163 protrudes into the roll paper compartment 121 before the roll paper 106 is stored in the roll paper compartment 121 when the operable cover unit 101*b* is closed, and the roll paper 106 is held between the detection lever 163 and operable cover unit 101*b*.

More specifically, if the operable cover unit 101*b* is closed when the diameter of the roll paper 106 is small (such as when the outside diameter is approximately 50 mm) and the 106 contacts the first roller 142 (FIG. 13), the detection lever 163 protrudes into the roll paper compartment 121 before the roll paper 106 rolls into the roll paper compartment 121. As a result, the roll paper 106 may become stuck between the detection lever 163 and the front panel 141 of the operable cover unit 101*b*.

However, a tapered surface 163*a* that rises to the top of the printer is formed at the front part of the detection lever 163 in this embodiment of the invention. The slope a of this tapered surface 163*a* is set so that if a small diameter roll 106 is between the tapered surface 163*a* and the front panel 141 of the operable cover unit 101*b*, the roll paper 106 can easily ride over the tapered surface 163*a*.

Figure 17:
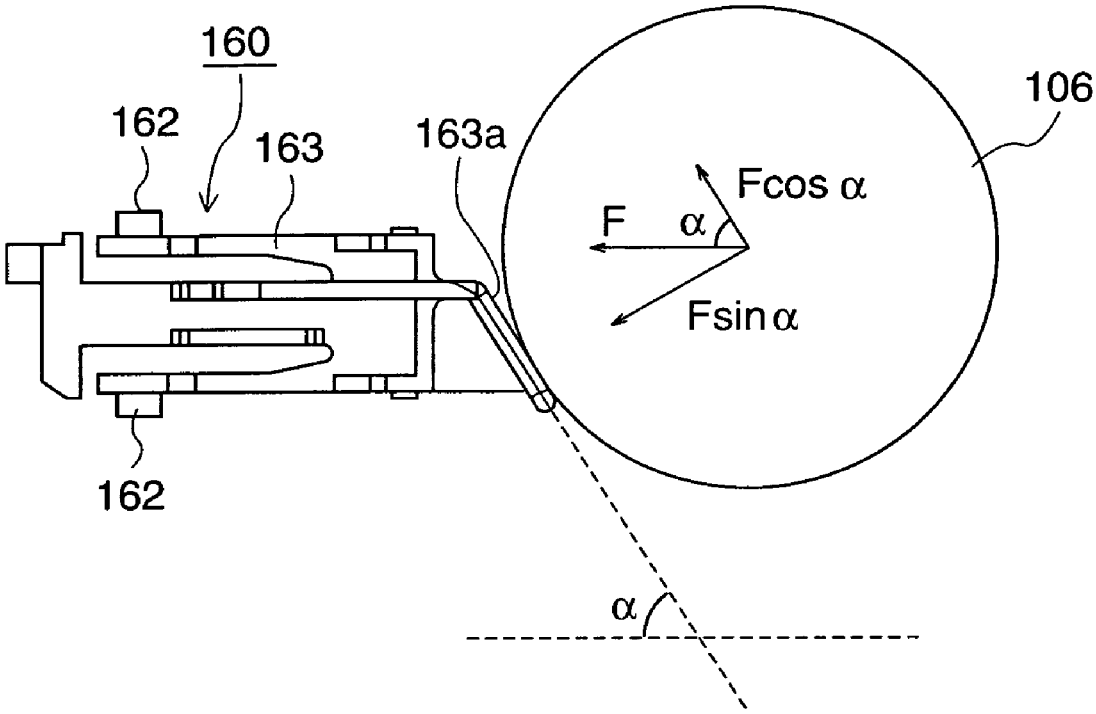
FIG. 17 describes a method of setting the inclination angle of the detection lever contact surface.

More specifically, as shown in FIG. 17, when force F is applied horizontally to the tapered surface 163*a* by the roll paper 106, this force F is split into force Fcosa acting in the direction of the slope of the tapered surface 163*a*, and force Fsina acting perpendicularly to the slope. If p is the static friction coefficient of the tapered surface 163*a*, slope a of the tapered surface 163*a* is set so that the equation $$F\cos a > \mu F\sin a$$

is true. In other words, slope a is set to an angle $$< \tan^{-1}(1/\mu).$$

When thus configured, the roll paper 106 slides along the upward-facing tapered surface 163*a* and is stored in the roll paper compartment 121 when the operable cover unit 101*b* closes even if the detection lever 163 protrudes into the roll paper compartment 121 so that the roll paper 106 is between the detection lever 163 and the front panel 141 of the operable cover unit 101*b* before the roll paper 106 is stored in the roll paper compartment 121.

As described above, a roll paper printer 100 according to this embodiment of the invention has a detection lever retraction mechanism that moves the detection lever 163 in conjunction with opening and closing the operable cover unit 101*b*. When the operable cover unit 101*b* opens, the detection lever 163 retracts to the outside of the roll paper compartment 121 as the operable cover unit 101*b* opens. The detection lever 163 of the roll paper size detection mechanism 160 therefore does not protrude into the roll paper compartment 121 when the operable cover unit 101*b* is open, and the roll paper 106 can be easily replaced, removed, or loaded.

During paper transportation, the roll paper 106 is pressed toward the operable cover unit 101*b* in this embodiment of the invention, and the near-end of the roll paper 106 can be detected by means of the detection lever 163 that is pushed against the round end surface of the roll paper 106. As a result, the roll paper 106 can be held so that it does not move to the front of the roll paper compartment 121 without providing a channel in the bottom of the roll paper compartment 121 as is required by the prior art. The size of the roll paper printer 100 can therefore be reduced an amount corresponding to the savings achieved by omitting this channel, and the near-end of the roll paper 106 can be reliably detected.

Furthermore, when the detection lever 163 of the roll paper size detection mechanism 160 is pressed against the round end surface 106*a* of the roll paper 106 and the roll paper 106 is consumed so that the outside diameter of the roll paper 106 is small, the detection lever 163 separates from the outside edge of the round end surface 106*a* of the roll paper 106 toward the back of the printer and protrudes into the roll paper compartment 121. Compared with an arrangement in which the detection lever is inserted to a hole in the center of the roll paper 106 core, the arrangement of this embodiment of the invention enables detecting the near-end of the roll paper 106 more easily.

In addition, a tapered surface 163*a* is formed on the front end part of the detection lever 163, and the slope a of the tapered surface 163*a* is set to an angle enabling the roll paper 106 to move smoothly over the tapered surface 163*a* and be stored in the roll paper compartment 121 when the roll paper 106 is between the tapered surface 163*a* and operable cover unit 101*b*. As a result, the roll paper 106 travels over the tapered surface 163*a* of the detection lever 163 and is stored in the roll paper compartment 121 even if the detection lever 163 protrudes into the roll paper compartment 121 and the roll paper 106 is disposed between the detection lever 163 and the operable cover unit 101*b* before the roll paper 106 is stored into the roll paper compartment 121 when closing the operable cover unit 101*b*. The problem of the roll paper 106 being locked between the tapered surface 163*a* and the operable cover unit 101*b* is thus prevented.

A contact surface 163*b* that tapers to the back of the printer is disposed on the side portion of the detection lever 163 so that the detection lever 163 again contacts the round end surface 106*a* of the roll paper 106 if the roll paper 106 moves to the back inside the roll paper compartment 121, the detection lever 163 separates from the round end surface 106*a* of the roll paper 106, and the roll paper 106 then moves to the front of the roll paper compartment 121 again. The roll paper 106 therefore returns to the predetermined position even if the roll paper 106 moves inside the roll paper compartment 121 due to vibration, for example, and detecting the near-end of the roll paper 106 can continue.

Figure 18A:
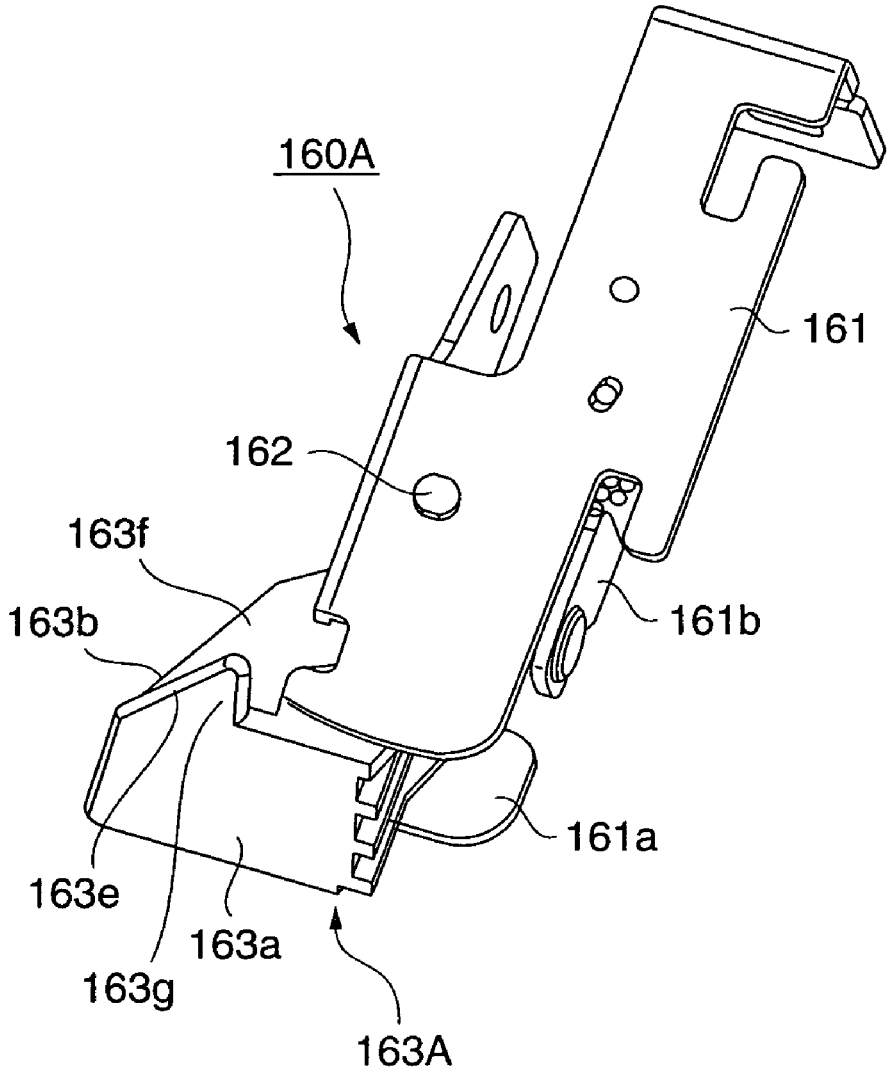
FIG. 18A and FIG. 18B are oblique views showing a variation of the roll paper size detection mechanism.
Figure 18B:
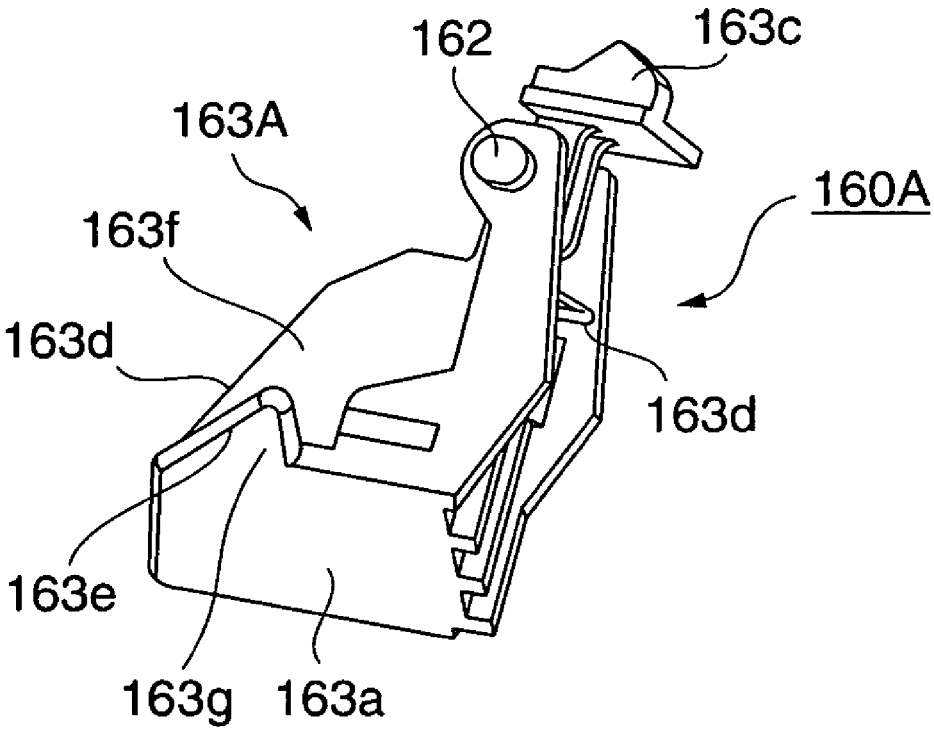

A variation of the roll paper size detection mechanism 160 is described next with reference to FIG. 18A and FIG. 18B. FIG. 18A is an oblique view from the top of this roll paper size detection mechanism 160A, and FIG. 18B is an oblique view of the detection lever 163A. Note that parts with the same or similar function in the figures are identified by the same reference numerals, and further description thereof is omitted.

This roll paper size detection mechanism 160A differs from the roll paper size detection mechanism 160 described above in that an inclined guide surface 163*e* facing the printer top and the inside side is rendered on the top part 163*f* of the detection lever 163A. This guide surface 163*e* is formed on the side of a vertical extension 163*g* of tapered surface 163*a* of the detection lever 163A, and this guide surface 163*e* has a slope declining to the contact surface 163*b*.

As described above, the detection lever 163 may protrude to the inside of the roll paper compartment 121 before the roll paper 106 is stored in the roll paper compartment 121 when the operable cover unit 101*b* closes. Depending on the outside diameter of the roll paper 106, the roll paper 106 could ride up on the top part 163*f* of the detection lever 163A when the operable cover unit 101*b* is closed quickly.

A tapered guide surface 163*e* is therefore formed on the top part 163*f* in this embodiment. Because the outside circumference edge of the roll paper 106 contacts this tapered guide surface 163*e* from above, the weight and the corresponding acceleration of gravity of the roll paper 106 cause the detection lever 163A to be pushed smoothly to the outside of the roll paper compartment 121.

As a result, the roll paper 106 moves on the roll paper holder 129, and the contact surface 163*b* touches the round end surface 106*a* of the roll paper 106. Therefore, when the roll paper 106 is small and the operable cover unit 101*b* is closed quickly with force so that the roll paper 106 rides up onto the detection lever 163A, the detection lever 163A is pushed by the roll paper 106 in contact with the tapered guide surface 163*e*, and is held pressed against the round end surface 106*a* of the roll paper 106. Detecting the near-end of the roll paper can therefore continue.

This aspect of the invention describes rendering a tapered guide surface 163*e* on an extension of the tapered surface 163*a*, but the tapered guide surface can be rendered on all of the top part 163*f*, or tapered guide ribs can be rendered on the top part 163*f*.

The invention has been described using by way of example a roll paper printer having a thermal print head. It will be obvious to one with ordinary skill in the related art that the invention can also be applied to roll paper printers using other types of print heads, including, for example, inkjet heads or dot impact heads.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A roll paper printer comprising:

a roll paper storage unit having a bottom surface on which a roll paper is held and rolls;

an operable cover unit for opening and closing a roll paper loading opening to the roll paper storage unit;

a roll paper size detection mechanism comprising a detection lever that can move in a direction protruding into the roll paper storage unit and a direction retracting from the roll paper storage unit, and an urging member for urging the detection lever in the protruding direction, wherein the detection lever separates from the roll paper and is pushed in the protruding direction when an outside diameter of the roll paper stored in the roll paper storage unit decreases to a predetermined size or less; and a detection lever retraction mechanism for moving the detection lever protruding into the roll paper storage unit in the retracting direction against the urging force of the urging member in conjunction with the operable cover unit opening.

2. The roll paper printer described in claim 1, wherein:

the detection lever retraction mechanism operates in conjunction with the opening and closing action of the operable cover unit, and comprises a moving plate that moves between a first position separated from the detection lever, and a second position pushing the detection lever in the retraction direction.

3. The roll paper printer described in claim 2, wherein:

the detection lever retraction mechanism comprises an urging member for urging the moving plate toward the first position.

4. The roll paper printer described in claim 2, wherein said detection lever (51) includes a tab (53) that projects to an inside of said roll paper storage unit (9), wherein said tab (53) is held pressed against said roll paper (10) until a diameter of said roll paper (10) decreases to a predetermined size.

5. The roll paper printer described in claim 4, wherein said tab (53) includes tapers (53*a* and 53*b*) formed on an outside surface of a distal end thereof that prevent interference with an edge in a side panel (33) and facilitate being pushed by the moving plate (72).

6. The roll paper printer described in claim 1, wherein:

the detection lever is pressed against a round end of the roll paper stored in the roll paper storage unit, and when the outside diameter of the roll paper decreases to a predetermined size or less, the detection lever separates from the round end of the roll paper and is pushed in the protruding direction.

7. The roll paper printer described in claim 6, wherein:

the detection lever is pushed in the protruding direction to separate from an inside circumference edge of the round end of the roll paper and enter a core hole positioned in the center of the round end of the roll paper.

8. The roll paper printer described in claim 7, wherein:

the roll paper storage unit stores the roll paper with the rotational axis of the roll paper aligned widthwise to the printer;

the protruding direction and retraction direction of the detection lever is aligned widthwise to the printer;

the roll paper loading opening is formed to the roll paper storage unit at a front side of the printer; and the operable cover unit can open to a front of the printer pivoting on a bottom end part of the operable cover unit, and has a platen defining the printing position of the print head attached at a top end portion of the operable cover unit.

9. The roll paper printer described in claim 8, wherein:

the detection lever retraction mechanism operates in conjunction with opening and closing the operable cover unit, and comprises a moving plate that moves in a front-to-back direction of the printer between a retreated position separated from the detection lever and an advanced position pushing the detection lever in a retraction direction.

10. The roll paper printer described in claim 9, wherein:

the detection lever retraction mechanism comprises an urging member for urging the moving plate towards the back of the printer.

11. The roll paper printer described in claim 6, wherein:

the detection lever is pushed in the protruding direction when the detection lever separates from an outside circumference edge of the roll paper.

12. The roll paper printer described in claim 11, wherein:

the roll paper storage unit stores the roll paper with the rotational axis of the roll paper aligned widthwise to the printer;

the detection lever is pushed in the protruding direction when the detection lever separates from the outside circumference edge of the roll paper;

the roll paper loading opening is formed on the roll paper storage unit at the front side of the printer;

the operable cover unit can open to the front side of the printer pivoting on a bottom end part of the operable cover unit, and has a platen defining the printing position of the print head attached at a top end portion of the operable cover unit; and the roll paper stored in the roll paper storage unit is pressed to a side of the operable cover unit while being advanced toward the printing position.

13. The roll paper printer described in claim 12, wherein:

an upward-facing tapered surface rising toward the printer top is formed at a front end part of the detection lever facing the operable cover unit; and the slope of the upward-facing tapered surface is set so that pushing the operable cover unit in the closing direction enables roll paper disposed between the upward-facing tapered surface and the operable cover unit to move over the upward-facing tapered surface to the back side of the detection lever.

14. The roll paper printer described in claim 13, wherein said slope is set so that the following equation is satisfied:

$$F^*\cos(a)>u^*F^*\sin(a),$$

wherein F is a horizontal force applied to the upward-facing tapered surface (163*a*) by the roll paper (106), and u is the static friction coefficient of the upward-facing tapered surface (163*a*).

15. The roll paper printer described in claim 14, further including an inclined guide surface (163*e*) formed on the detection lever (163).

16. The roll paper printer described in claim 15, wherein inclined said inclined guide surface (163*e*) is formed on one of: an extension (163*g*) of the tapered surface (163*a*); and a top part (163*f*) of the detection lever (163).

17. The roll paper printer described in claim 12, wherein:

a back-facing tapered surface facing the printer back is formed at a side part of the detection lever facing the roll paper storage unit; and the back-facing tapered surface can contact the outside circumference edge part of the end of roll paper moving from the back of the detection lever to the front.

18. The roll paper printer described in claim 12, wherein:

a tapered guide surface facing the inside widthwise to the printer is formed at a top part of the detection lever; and this tapered guide surface can contact the outside circumference edge of the end of the roll paper moving down from the top of the detection lever.

19. The roll paper printer described in claim 1, further including a first roller (142) and a second roller (143) disposed below the first roller (142), wherein said first roller (142) contacts said roller paper (106) when a diameter of said roll paper (106) is large, and said second roller (143) contacts said roller paper (106) when a diameter of said roll paper (106) is small.

* * * * *